US011452331B2

(12) United States Patent
Cross et al.

(10) Patent No.: US 11,452,331 B2
(45) **Date of Patent: *Sep. 27, 2022**

(54) SOLE FOR AN ARTICLE OF FOOTWEAR HAVING REGIONALLY VARIED AUXETIC STRUCTURES

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 285 days.

This patent is subject to a terminal disclaimer.

(21) Appl. No.: 16/684,114

(22) Filed: Nov. 14, 2019

(65) Prior Publication Data

US 2020/0077738 A1 Mar. 12, 2020

Related U.S. Application Data

(60) Division of application No. 15/604,890, filed on May 25, 2017, now Pat. No. 10,499,704, which is a (Continued)

(51) Int. Cl.

| | |
|---|---|
| ***A43B 13/02*** | (2022.01) |
| ***A43B 13/12*** | (2006.01) |
| ***A43B 13/18*** | (2006.01) |
| ***A43B 13/14*** | (2006.01) |
| ***A43B 1/00*** | (2006.01) |

(Continued)

(52) U.S. Cl.

CPC ..... *A43B 13/02* (2013.01); *A43B 1/0009* (2013.01); *A43B 3/0073* (2013.01); *A43B 5/00* (2013.01); *A43B 13/122* (2013.01); *A43B 13/125* (2013.01); *A43B 13/14* (2013.01); *A43B 13/141* (2013.01); *A43B 13/181* (2013.01); *A43B 13/186* (2013.01); *A43B 13/187* (2013.01);

(Continued)

(58) Field of Classification Search

CPC ..... A43B 13/02; A43B 13/125; A43B 13/38; A43B 13/28; A43B 13/186; A43B 13/141; A43B 13/188; A43B 13/181; A43B 13/122; A43B 13/187; A43B 1/0009

See application file for complete search history.

(56) References Cited

U.S. PATENT DOCUMENTS 4,398,357 A * 8/1983 Batra ..... A43B 13/16 36/31
8,084,117 B2 * 12/2011 Lalvani ..... B31D 3/04 52/670

(Continued)

*Primary Examiner* — Shaun R Hurley
*Assistant Examiner* — Bao-Thieu L Nguyen
(74) *Attorney, Agent, or Firm* — Quinn IP Law

(57) ABSTRACT

A sole for article of footwear includes a midsole component having an inner surface and an outer surface opposite the inner surface. A plurality of blind holes each extends from the outer surface toward the inner surface. The plurality of blind holes are arranged in an auxetic configuration in the outer surface. Each hole in the plurality of holes extends towards the inner surface. The plurality of blind holes is arranged in a pattern that provides a tunable performance characteristic. The patterns of blind holes vary between different regions of the midsole component to provide different types of responses in the different regions.

6 Claims, 19 Drawing Sheets

Related U.S. Application Data continuation-in-part of application No. 15/398,750, filed on Jan. 5, 2017, now Pat. No. 10,271,615, and a continuation-in-part of application No. 15/389,844, filed on Dec. 23, 2016, now Pat. No. 10,455,894, which is a continuation of application No. 14/643,121, filed on Mar. 10, 2015, now Pat. No. 9,538,811, which is a division of application No. 14/643,427, filed on Mar. 10, 2015, now Pat. No. 9,549,590, which is a continuation-in-part of application No. 14/030,002, filed on Sep. 18, 2013, now Pat. No. 9,402,439, which is a continuation-in-part of application No. 14/030,002, filed on Sep. 18, 2013, now Pat. No. 9,402,439.

(51) Int. Cl.

| | |
|---|---|
| ***A43B 3/00*** | (2022.01) |
| ***A43B 5/00*** | (2022.01) |
| ***A43B 13/28*** | (2006.01) |
| ***A43B 13/38*** | (2006.01) |

(52) U.S. Cl.

CPC ..... *A43B 13/188* (2013.01); *A43B 13/28* (2013.01); *A43B 13/38* (2013.01)

(56) References Cited

U.S. PATENT DOCUMENTS

| | | | | |
|---|---|---|---|---|
| 9,402,439 | B2 * | 8/2016 | Cross | A43B 13/223 |
| 9,538,811 | B2 * | 1/2017 | Cross | A43B 13/28 |
| 9,549,590 | B2 * | 1/2017 | Cross | A43B 13/141 |
| 9,554,622 | B2 * | 1/2017 | Cross | A43B 13/14 |
| 10,206,454 | B2 * | 2/2019 | Langvin | A43B 13/141 |
| 10,206,455 | B2 * | 2/2019 | Lawless | A43B 13/223 |
| 10,271,615 | B2 * | 4/2019 | Cross | A43B 1/0009 |
| 10,278,448 | B2 * | 5/2019 | Cross | A43B 13/125 |
| 10,455,894 | B2 * | 10/2019 | Cross | A43B 13/181 |
| 10,499,704 | B2 * | 12/2019 | Cross | A43B 13/141 |
| 10,993,501 | B2 * | 5/2021 | Lawless | A43B 13/125 |
| 2009/0056172 | A1 * | 3/2009 | Cho | A43B 7/081 36/3 R |
| 2009/0183388 | A1 * | 7/2009 | Miller | A43D 1/022 36/43 |
| 2010/0095551 | A1 * | 4/2010 | Gupta | A43B 13/189 36/35 B |
| 2011/0159758 | A1 * | 6/2011 | Martin | A62B 23/025 264/299 |
| 2012/0056350 | A1 * | 3/2012 | Torii | B82Y 40/00 428/156 |
| 2013/0000157 | A1 * | 1/2013 | Wu | A43B 13/12 36/30 A |
| 2018/0009257 | A1 * | 1/2018 | Bertoldi | C22C 19/05 |
| 2018/0064205 | A1 * | 3/2018 | Cross | A43B 5/00 |
| 2018/0073943 | A1 * | 3/2018 | Zeng | G01L 1/26 |
| 2018/0264774 | A1 * | 9/2018 | Bertoldi | B32B 3/30 |
| 2018/0264775 | A1 * | 9/2018 | Bertoldi | B32B 15/01 |

* cited by examiner

SOLE FOR AN ARTICLE OF FOOTWEAR HAVING REGIONALLY VARIED AUXETIC STRUCTURES

CROSS-REFERENCE TO RELATED APPLICATIONS

This application is a divisional of U.S. application Ser. No. 15/604,890, which is published as US 2017/0258178, and filed on May 25, 2017, which is a continuation in part of U.S. application Ser. No. 15/398,750, which is issued as U.S. Pat. No. 10,271,615, which is a continuation of U.S. application Ser. No. 14/643,121, issued as U.S. Pat. No. 9,538,811, which is a continuation in part of U.S. application Ser. No. 14/030,002, issued as U.S. Pat. No. 9,402,439.

Application Ser. No. 15/604,890 is also a continuation in part of U.S. patent application Ser. No. 15/389,844, issued as U.S. Pat. No. 10,455,894, which is a divisional of U.S. application Ser. No. 14/643,427, issued as U.S. Pat. No. 9,549,590, which is a continuation in part of U.S. patent application Ser. No. 14/030,002, issued as U.S. Pat. No. 9,402,439. The entire disclosures of each of the above-referenced patent references are hereby incorporated by reference in their entirety and for all purposes.

BACKGROUND

The present embodiments relate generally to articles of footwear, and in particular to articles of footwear with uppers and sole structures. Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views

DETAILED DESCRIPTION

Figure 1:
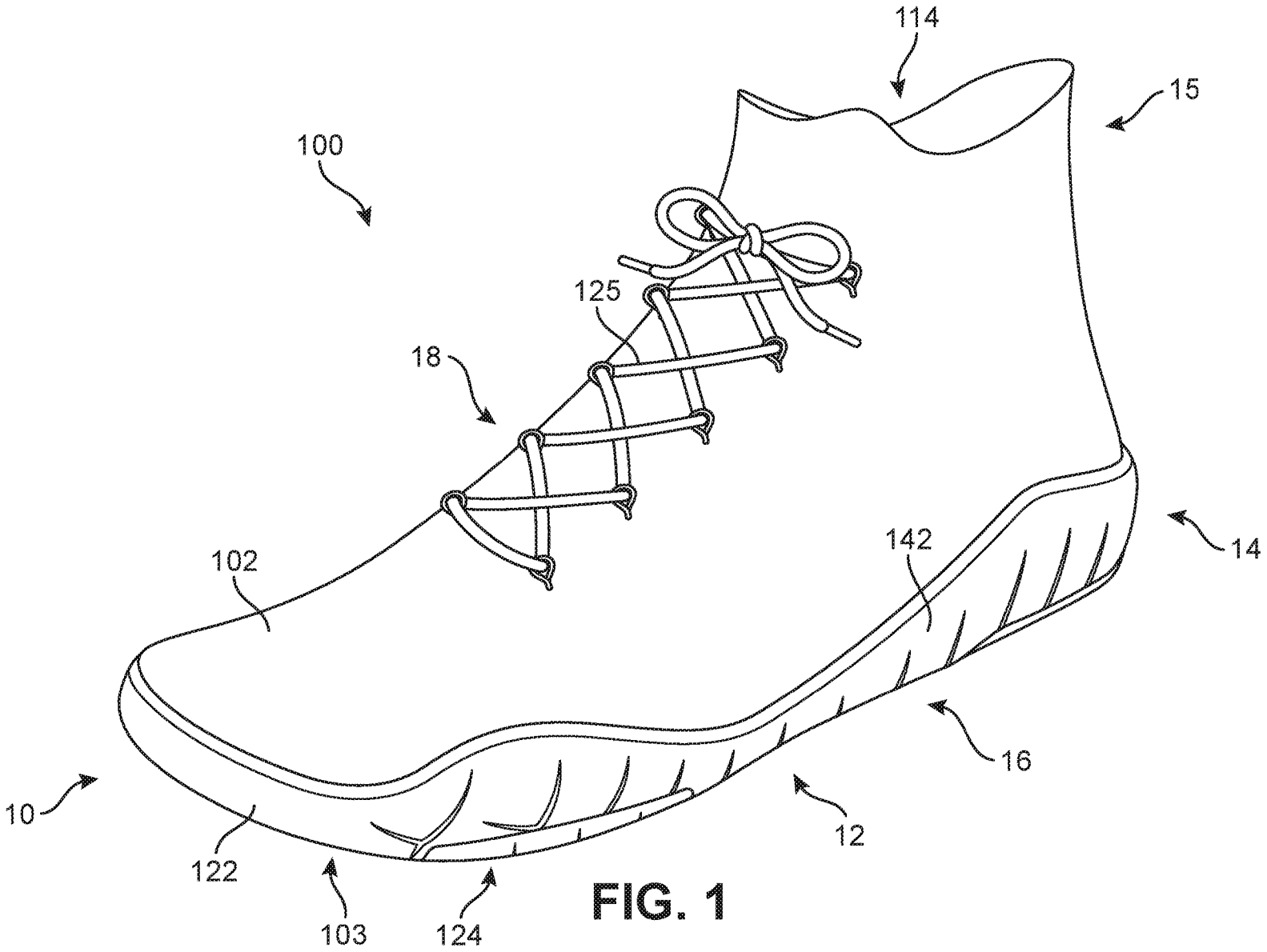
FIG. 1 is a perspective view of an embodiment of an article of footwear having a sole with auxetic structures arranged in a pattern on the sole

In one aspect, the present disclosure describes a sole for an article of footwear that includes a midsole component having an inner surface and an outer surface opposite the inner surface. The midsole component has a plurality of blind holes. Each blind hole extends from the outer surface toward the inner surface. The plurality of blind holes is arranged in an auxetic configuration in the outer surface. Each hole in the plurality of holes extends towards the inner surface. The blind holes are arranged in an auxetic configuration in the outer surface of the midsole component. The plurality of blind holes includes a first plurality of blind holes in a first region and a second plurality of blind holes in a second region. The first plurality of blind holes has an attribute that is different than a similar attribute of the second plurality of blind holes to provide the first region with a performance characteristic that is different from the second region. The attributes of the first region and the second regions may be the depth of penetration of the blind holes into the midsole component. The article of footwear may be tuned using auxetic structures. With the auxetic structures, the ride, fit, and cushioning across the sole structure can be customized. Such customization is generally not possible when using a monolithic rubber or foam sole. The heel region is configured to absorb energy, while providing lateral stability. The midfoot region can be stiffer than the heel region and/or non-auxetic, because the foot exerts very little contact pressure at the midfoot portion when compared with the heel region. The forefoot region has enough firmness and structure to enable a good/firm push-off without needing to dig out of a mushy cushion. The presently disclosed sole provides another dimension of sole-response customization to control cushioning and support. In addition, it may be preferable to have deeper cuts in the center of the sole for cushioning, and shallower cuts along the periphery of the sole for stability.

In another aspect, the present disclosure describes a method of making a sole having performance characteristics. The method includes the following steps: (1) providing a midsole component of the sole, wherein the midsole component has a midsole thickness; and (2) forming a plurality of blind holes in an auxetic configuration on the midsole, wherein the plurality of blind holes has an attribute in a portion of the sole to provide a performance characteristic in the portion, and each of the plurality of blind holes extends from an outer surface of the midsole component to a depth in the midsole thickness.

In another aspect, the present disclosure describes a method of customizing the sole. The method includes the following steps: (1) determining a performance characteristic for a portion of the sole; (2) correlating the performance characteristic to an attribute of a plurality of blind holes; and (3) forming the plurality of blind holes in the sole, wherein the plurality of blind holes are arranged in an auxetic configuration and have the attribute, wherein the attribute imparts the performance characteristic to the portion of the sole.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

Articles of footwear are provided with soles that include patterns of blind auxetic holes. The depth of penetration of the holes into the midsole may vary in different regions of the sole to provide different degrees of auxetic motion (expansion or contraction). Auxetic holes with a relatively deep penetration into the thickness of a sole structure will expand and contract to a greater degree than auxetic holes with relatively shallow penetration into the thickness of the sole structure. These differences in the amount of expansion and contraction of the auxetic structures may allow a sole to have a tunable response to applied forces. Different patterns of the auxetic structures in the different regions provide different responses in the different regions, depending upon the anticipated type of desired response.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of an inner sole component, a midsole component, an outer sole component, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14 and ankle portion 15.

Figure 2:
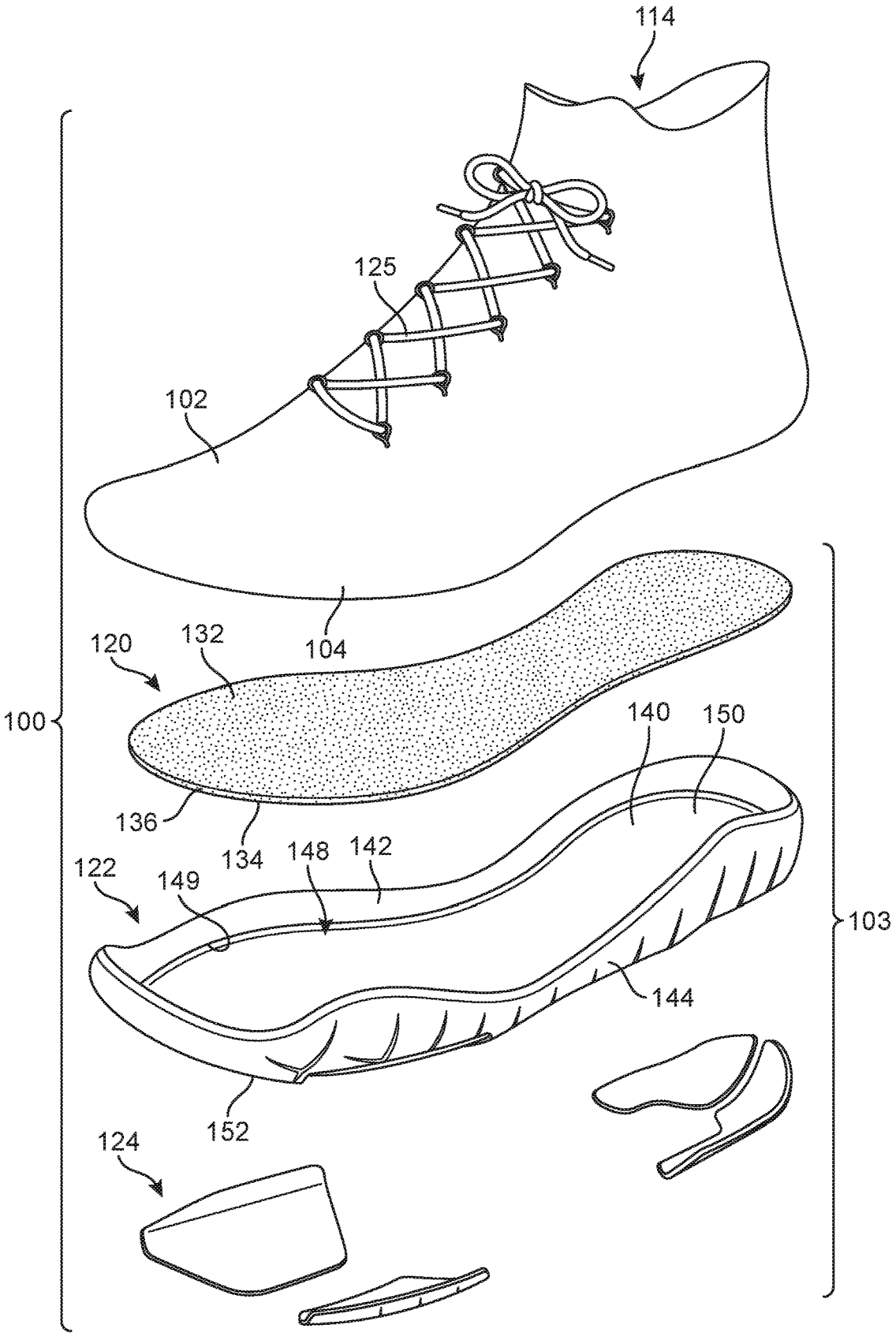
FIG. 2 is an exploded view of the article of footwear of FIG. 1.

FIG. 2 illustrates an exploded isometric view of an embodiment of article of footwear 100. FIGS. 1-2 illustrate various components of article of footwear 100, including an upper 102 and a sole structure 103.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, upper 102 includes opening 114 that provides entry for the foot into an interior cavity of upper 102. In some embodiments, upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

An upper could be formed from a variety of different manufacturing techniques resulting in various kinds of upper structures. For example, in some embodiments, an upper could have a braided construction, a knitted (e.g., warp-knitted) construction or some other woven construction. In an exemplary embodiment, upper 102 may be a knitted upper.

In some embodiments, sole structure 103 may be configured to provide traction for article 100. In addition to providing traction, sole structure 103 may attenuate ground reaction forces when compressed between the foot and the ground during walking, running or other ambulatory activities. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to: natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In the exemplary embodiment shown in FIGS. 1-2, sole structure 103 may include inner sole component 120, midsole component 122 and a plurality of outer sole members 124. In some cases, one or more of these components may be optional.

In different embodiments, upper 102 and sole structure 103 could be joined in various ways. In some embodiments, upper 102 could be joined to inner sole component 120, e.g., using an adhesive or by stitching. In other embodiments, upper 102 could be joined to midsole component 122, for example, along sidewall portion 142. In still other embodiments, upper 102 could be joined with both inner sole component 120 and midsole component 122. Moreover, these components may be joined using any methods known in the art for joining sole components with uppers, including various lasting techniques and provisions (e.g., board lasting, slip lasting, etc.).

In different embodiments, the attachment configurations of various components of article 100 could vary. For example, in some embodiments, inner sole component 120 could be bonded or otherwise attached to midsole component 122. Such bonding or attachment could be accomplished using any known methods for bonding components of articles of footwear, including, but not limited to: adhesives, films, tapes, staples, stitching, or other methods. In some other embodiments, it is contemplated that inner sole component 120 may not be bonded or attached to midsole component 122, and instead could be free-floating. In at least some embodiments, inner sole component 120 may have a friction fit with central recess 148 of midsole component 122.

Outer sole members 124 may be likewise bonded or otherwise attached to midsole component 122. Such bonding or attachment could be accomplished using any known methods for bonding components of articles of footwear, including, but not limited to adhesives, films, tapes, staples, stitching, or other methods.

It is contemplated that in at least some embodiments, two or more of inner sole component 120, midsole component 122 and/or outer sole members 124 could be formed and/or bonded together during a molding process. For example, in some embodiments, upon forming midsole component 122, inner sole component 120 could be molded within central recess 148.

Referring now to FIG. 2, in some embodiments, inner sole component 120 may be configured as an inner layer for a midsole. For example, as discussed in further detail below, inner sole component 120 may be integrated, or received, into a portion of midsole component 122. However, in other embodiments, inner sole component 120 could function as an insole layer and/or as a strobel layer. Thus, in at least some embodiments, inner sole component 120 could be joined (e.g., stitched or glued) to lower portion 104 of upper 102 for purposes of securing sole structure 103 to upper 102.

Inner sole component 120 may have an inner surface 132 and an outer surface 134. Inner surface 132 may generally be oriented towards upper 102. Outer surface 134 may be generally oriented towards midsole component 122. Furthermore, a peripheral sidewall surface 136 may extend between inner surface 132 and outer surface 134.

Midsole component 122 may be configured to provide cushioning, shock absorption, energy return, stability, support, as well as possibly other provisions. To this end, midsole component 122 may have a geometry that provides structure and support for article 100. Specifically, midsole component 122 may be seen to have a lower portion 140 and a sidewall portion 142. Sidewall portion 142 may extend around the entire midsole periphery 144 of midsole component 122. As seen in FIG. 1, sidewall portion 142 may partially wrap up the sides of article 100 to provide increased support along the base of the foot.

Midsole component 122 may further include an inner surface 150 and an outer surface 152. Inner surface 150 may be generally oriented towards upper 102, while outer surface 152 may be oriented outwardly. Furthermore, in the exemplary embodiment, midsole component 122 includes a central recess 148 disposed in inner surface 150. Central recess 148 may generally be sized and configured to receive inner sole component 120.

In some embodiments, midsole component 122 may include a plurality of holes. In the exemplary embodiment shown in FIG. 2, none of the plurality of holes is visible within central recess 148. In this embodiment, all of the holes are blind holes that are open in outer surface 152 and terminate between outer surface 152 and inner surface 150.

In different embodiments, midsole component 122 may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

As seen in FIG. 2, plurality of outer sole members 124 comprises four distinct outer sole members. Although the exemplary embodiment includes four different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, five or more outer sole members could be used.

Generally, an outer sole member may be configured as a ground contacting member. In some embodiments, an outer sole member could include properties associated with outsoles, such as durability, wear-resistance and increased traction. In other embodiments, an outer sole member could include properties associated with a midsole, including cushioning, strength and support. In the exemplary embodiment, plurality of outer sole members 124 may be configured as outsole-like members that enhance traction with a ground surface while maintaining wear resistance.

Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Sole structure 103 as shown in FIGS. 1-11 and as described further in detail below, has an auxetic structure or configuration. Sole structures comprising auxetic structures are described in U.S. Patent Application Publication 2015/0075033 (the '033 Publication), the entirety of which is hereby incorporated by reference.

Figure 4:
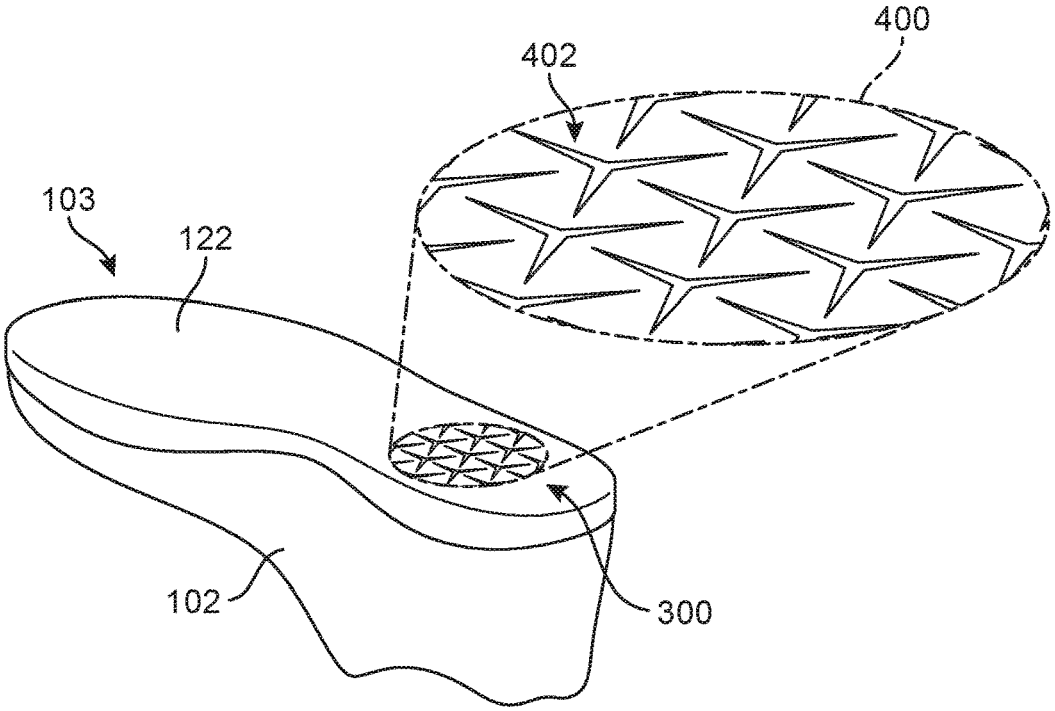
FIG. 4 is a bottom isometric view of an embodiment of a sole structure including an enlarged schematic view of a portion of the sole structure
Figure 5:
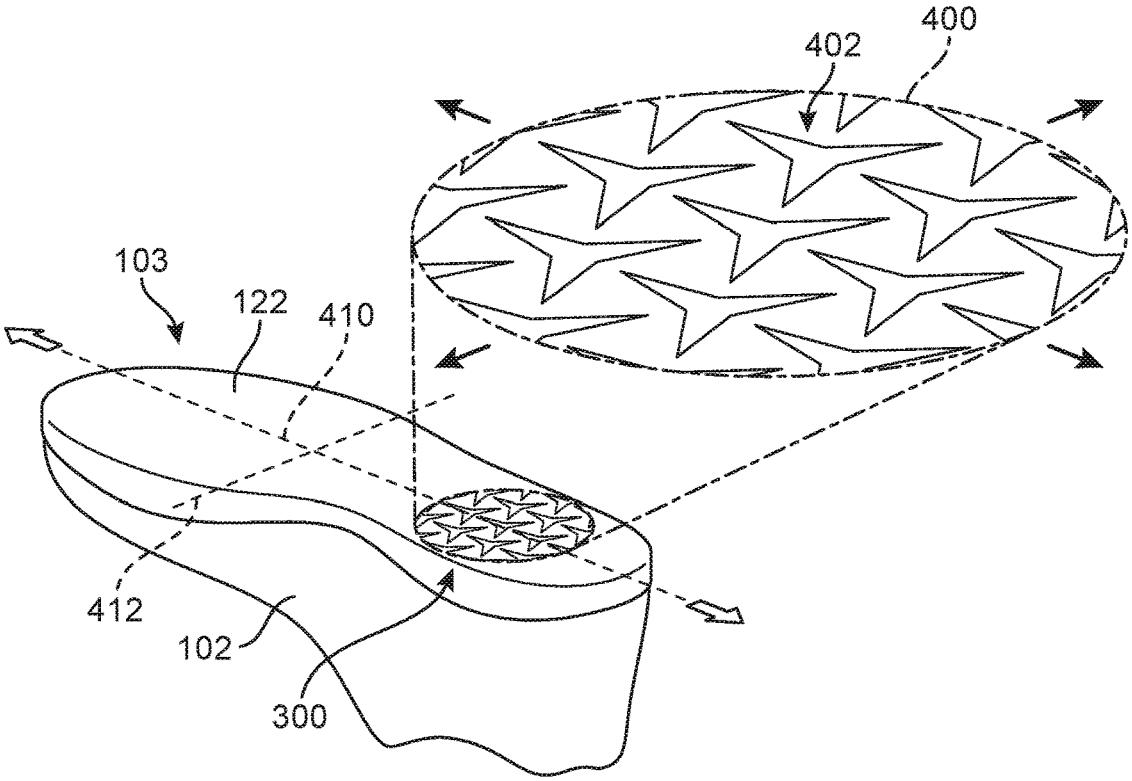
FIG. 5 is a bottom isometric view of an embodiment of a sole structure including an enlarged schematic view of a portion of the sole structure, in which the portion of the sole structure is undergoing auxetic expansion.

As described in the '033 Publication, auxetic materials have a negative Poisson's ratio. When under tension in a first direction, the dimensions of the auxetic materials increase both in the first direction and in a second direction orthogonal or perpendicular to the first direction. This property of an auxetic material is illustrated in FIGS. 4 and 5.

Figure 3:
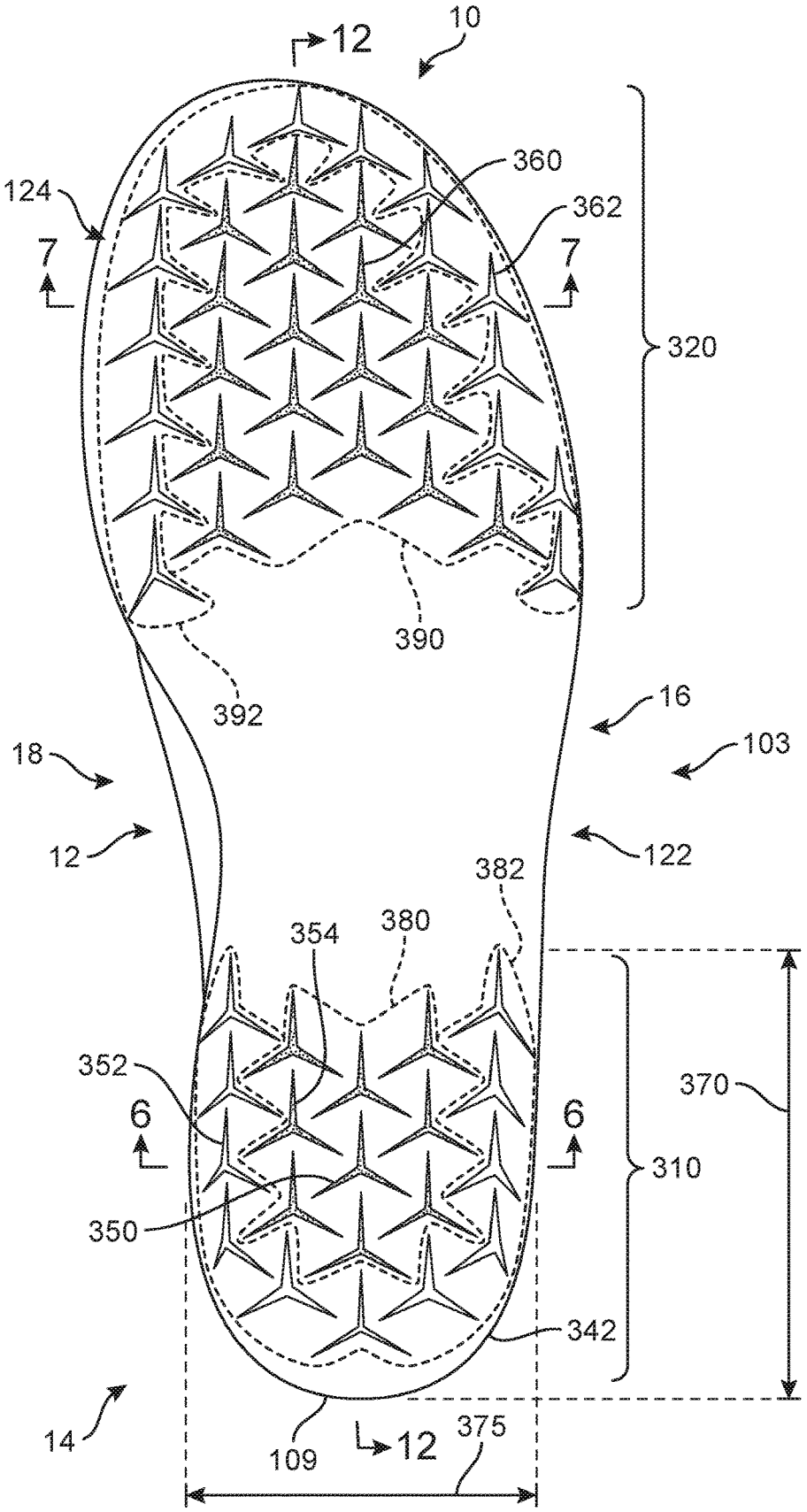
FIG. 3 is a plan view of an embodiment of a midsole portion of the article of footwear of FIG. 1.

As seen in FIG. 3, sole structure 103 may include a plurality of holes 300 (shown in FIGS. 4 and 5), which include plurality of heel holes 310 and plurality of forefoot holes 320. As used herein, the term "hole" refers to any hollowed area or recessed area in a component. In some cases, a hole may be a through hole, in which the hole extends between two opposing surfaces of a component. In other cases, a hole may be a blind hole, in which the hole may not extend through the entire thickness of the component and may therefore only be open on one side. Moreover, as discussed in further detail below, a component may utilize a combination of blind holes with different degrees of penetration into the midsoles. Furthermore, the term "hole" may be used interchangeably in some cases with "aperture" or "recess".

In different embodiments, the geometry of one or more holes could vary. Examples of different geometries that could be used for an auxetic sole structure are disclosed in the '033 Publication. Moreover, embodiments could also utilize any other geometries, such as utilizing sole portions with parallelogram geometries or other polygonal geometries that are arranged in a pattern to provide the sole with an auxetic structure. In the exemplary embodiment, each hole of plurality of holes 300 has a tri-star geometry, including three arms or points extending from a common center.

Plurality of holes 300 (shown in FIGS. 4 and 5) may be arranged on sole structure 103 in an auxetic pattern, or auxetic configuration. In other words, plurality of holes 300 may be arranged on midsole component 122 and/or outer sole members 124 in a manner that allows those components to undergo auxetic motions, such as expansion or contraction. An example of auxetic expansion, which occurs as the result of the auxetic configuration of plurality of holes 300, is shown in FIGS. 4 and 5. Initially, in FIG. 4, sole structure 103 is in a non-tensioned state. In this state, plurality of holes 300 have an un-tensioned area. For purposes of illustration, only a region 400 of midsole component 122 is shown, where region 400 includes a subset of holes 402.

As tension is applied across sole structure 103 along an exemplary linear first direction 410 (e.g., a longitudinal direction), as shown in FIG. 5, sole structure 103 undergoes auxetic expansion. That is, sole structure 103 expands along first direction 410 (e.g., a longitudinal direction), as well as in a second direction 412 (e.g., a lateral direction) that is perpendicular to first direction 410. In FIG. 5, the representative region 400 is seen to expand in both first direction 410 and second direction 412 simultaneously, as subset of holes 402 increase in size.

Embodiments can include provisions for varying the degree to which some portions of a sole structure (including portions of a midsole component and/or outer sole members) may undergo auxetic expansion. Because expansion of the sole structure may result in increased surface contact and/or increased flexibility for regions of the sole structure, varying the degree to which different regions or portions expand (or contract) under tension (or compression) may allow the traction, cushioning, stability, and/or flexibility properties of those different regions to be tuned.

Such variation may be used to tune responses of the midsole component in different regions. For example, the midsole may be designed so that auxetic expansion in a heel may be greater in response to a hard heel strike than for a softer heel strike. Further, the same midsole may be designed for increased stability in the forefoot.

Varying the degree to which a midsole component undergoes auxetic expansion can be achieved by varying the properties of different openings. The tuning effect may be achieved using different types of auxetic structures in different regions of the midsole while using patterns of different types of auxetic structures within a region of the midsole. For example, a particular auxetic shape or size of an auxetic shape may be selected to control the amount of auxetic expansion of any particular auxetic structure. Selecting a pattern or combination of auxetic shapes/sized for a region can allow the region to be tuned to various performance characteristics. Some performance characteristics may be more cushioning for hard impacts, more stability to control rolling tendencies, and/or customized cushioning based upon a user profile.

As shown above in FIG. 2 as well as in FIG. 3, all of the auxetic structures on midsole component 122 are blind holes having a tri-star geometry, though in other embodiments, the particular auxetic shape may differ. In the embodiment shown in FIG. 3, heel portion 14 contains a plurality of heel portion holes 310 (also referred to simply as "heel holes 310") and forefoot portion 10 contains a plurality of forefoot portion holes 320 (also referred to simply as "forefoot holes 320"). While midfoot portion 12 does not contain any holes in this embodiment, those of skill in the art may position holes in midfoot portion 12 as desired to achieve various performance characteristics and midsole responses.

As shown in FIG. 3, midsole component 122 has different types of auxetic holes disposed in predetermined patterns to tune the performance characteristics of midsole component 122. In the embodiments shown herein, the different types of auxetic holes differ based on the depth of penetration into an interior of midsole component 122. Midsole component 122 has an initial midsole heel thickness 600 (shown in FIG. 6) defined by inner surface 150 and outer surface 152. Because all of the holes of the present embodiment are blind holes, the holes are cut into or visible from only one of inner surface 150 and outer surface 152 and extend into and terminate within initial midsole heel thickness 600. For the sake of simplicity, all of the holes discussed herein are formed in or are visible from outer surface 152. As will be recognized by those of skill in the art, the holes may be formed in or may be visible from inner surface 150 or a combination of holes formed in or visible from either inner surface 150 or outer surface 152. As will be recognized by those of skill in the art, some embodiments may include through holes, which would be visible from both inner surface 150 and outer surface 152.

To provide tunability of performance characteristics in midsole component 122, each portion of midsole component 122 may have different combinations of auxetic hole types. For example, plurality of heel portion holes 310 (shown in FIG. 3) includes some deep holes and some shallow holes arranged in a particular pattern. The shallow holes are shallower than the deep holes. The deep holes will expand auxetically to a greater degree than the shallow holes in response to a similar force. Therefore, the overall auxetic expansion of a portion of midsole component 122 can be finely controlled.

For example, in the embodiment shown in FIG. 3, deeper holes or holes that penetrate further into the interior of midsole component 122 from outer surface 152 are generally positioned towards a central portion of midsole component 122 in a medial-to-lateral direction while shallow holes are positioned proximate midsole periphery 144. In heel portion 14, the deep holes are arranged into a plurality of deep heel holes 380, while in forefoot portion 10, the deep holes are arranged into a plurality of deep forefoot holes 390. Similarly, in heel portion 14, the shallow holes are arranged into a plurality of shallow heel holes 382, while in forefoot portion 10, the shallow holes are arranged into a plurality of shallow forefoot holes 392. In both heel portion 14 and forefoot portion 10, the shallow holes, such as plurality of shallow heel holes 382 and plurality of shallow forefoot holes 392, are positioned proximate midsole periphery 144. In both heel portion 14 and forefoot portion 10, the deep holes, such as plurality of deep heel holes 380 and plurality of deep forefoot holes 390, fill the space defined by the arrangement of the shallow holes. This pattern of shallow holes and deep holes may allow for a number of different responses of midsole component 122 when impacts or other forces are applied to midsole component 122, as the deep and shallow holes will auxetically expand to different degrees. In the embodiment shown in the figures, the shallow holes may constrain the expansion of the deep holes so that midsole component 122 may respond to a wider range of impact forces than a similar midsole lacking constrained holes. Due to the constraining effect of the shallow holes, at every magnitude, a force cannot expand the deep holes as much as unconstrained holes. Therefore, the deep holes will reach a maximum expansion at a higher magnitude force than for unconstrained holes. The pattern of shallow holes and deep holes shown in FIG. 3, therefore, increases the ability of heel portion 14 to respond appropriately to a wider range of impact forces. Consequently, the tunability of heel portion 14 is increased.

For example, in heel portion 14, plurality of shallow heel holes 382 is formed into a single-hole U-shaped pattern that follows the curvature defined by periphery 144. Plurality of deep heel holes 380 is positioned within the U-shape and extends from medial side 18 of heel portion 14 to lateral side 16 of heel portion 14 while remaining entirely within the pattern of plurality of shallow heel holes 382. This pattern of holes in heel portion 14 may accommodate a number of different types of heel strikes, as the centrally-located deep holes may expand to provide cushioning while the peripherally-located shallow holes may expand to a lesser degree to provide stability. Further, for hard impact forces, the holes may expand more than for softer heel strikes to provide greater cushioning and stability by increasing the total area of the midsole portion. Because the holes are all blind holes, the different expansion of the holes may be precisely controlled.

Similarly, in forefoot portion 10, plurality of shallow forefoot holes 392 is formed into a single-hole U-shaped pattern that follows the curvature defined by periphery 144. Plurality of deep forefoot holes 390 is positioned within the U-shape and extends from a medial side 18 of forefoot portion 10 to a lateral side 16 of forefoot portion 10 while remaining entirely within the pattern of plurality of shallow forefoot holes 392. This pattern of holes in forefoot portion 10 may accommodate a number of different types of forefoot forces, as the centrally-located deep holes may expand to provide cushioning while the peripherally-located shallow holes may expand to a lesser degree to provide stability.

Figure 6:
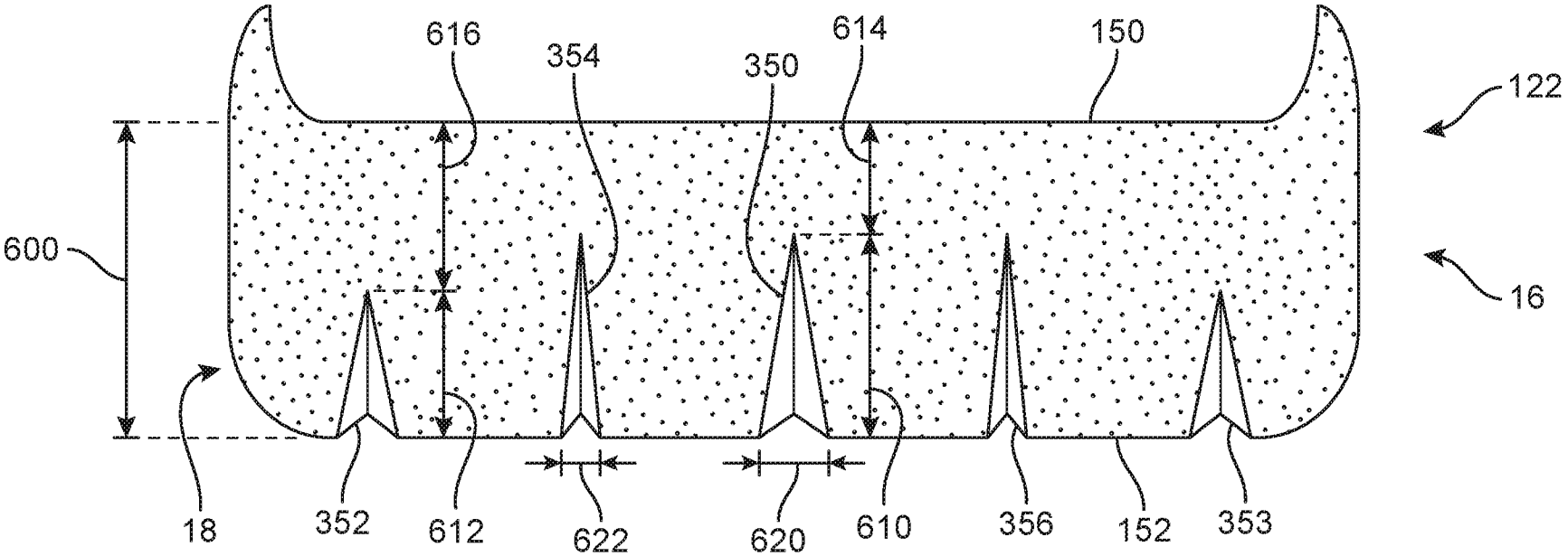
FIG. 6 is a cross-sectional view of an embodiment of a heel portion of the midsole component shown in FIG. 3 as taken along line 6-6.

These responses are shown and discussed with respect to FIGS. 6-11. FIG. 6 is a cross-sectional view of the midsole of FIG. 3 taken along line 6-6 though heel portion 14 when midsole component 122 is not subject to any external forces. This section of midsole component 122 includes five holes: a central deep heel hole 350, a medial deep heel hole 354, a lateral deep heel hole 356, a medial shallow heel hole 352, and a lateral shallow heel hole 353. Central deep heel hole 350 is disposed approximately midway between medial side 18 and lateral side 16. Medial shallow heel hole 352 is positioned proximate medial side 18, and lateral shallow heel hole 353 is positioned proximate lateral side 16. Medial deep heel hole 354 is disposed between central deep heel hole 350 and medial shallow heel hole 352. Lateral deep heel hole 356 is disposed between central deep heel hole 350 and lateral shallow heel hole 353. In other embodiments, the number, placement, and spacing of holes may differ, depending upon the desired response profile.

FIG. 6 clearly shows the depth penetration variation between the deep holes and the shallow holes. Central deep heel hole 350 extends from outer surface 152 into initial midsole heel thickness 600 a deep heel distance 610. Medial deep heel hole 354 and lateral deep heel hole 356 both extend the same deep heel distance 610 into midsole heel thickness 600. Viewed another way, central deep heel hole 350 may terminate within initial midsole heel thickness 600 a first heel distance 614 from inner surface 150.

Medial shallow heel hole 352 extends from outer surface 152 into initial midsole heel thickness 600 a shallow distance 612, where shallow distance 612 is less than deep heel distance 610. Lateral shallow heel hole 353 extends the same shallow distance 612 into initial midsole heel thickness 600. Viewed another way, medial shallow heel hole 352 may terminate a second heel distance 616 from inner surface 150. Second heel distance 616 is greater than first heel distance 614.

Deep heel distance 610 is greater than shallow distance 612, so that the deep holes penetrate further into initial midsole heel thickness 600 than do the shallow holes. Initial midsole heel thickness 600 may be any thickness known in the art suitable for midsoles. Deep heel distance 610 may be any distance that terminates within initial midsole heel thickness 600, and, therefore, depends upon factors such as initial midsole heel thickness 600, desired maximum auxetic expansion, and durability. Deep heel distance 610 may be selected for both auxetic expansion and durability; the termination point of deep heel distance 610 may be selected so that first heel distance 614 may yield sufficient material to withstand repeated expansion of central deep heel hole 350 without failure.

FIG. 6 shows heel portion 14 in an unflexed and unexpanded configuration. As such central deep heel hole 350 has an initial or first auxetic width 620. Similarly, all deep heel holes have a similar initial auxetic width at a similar position along the arm of the tri-star hole. However, because the arm of the tri-star hole tapers to a point, the initial auxetic widths of the other deep holes, medial deep heel hole 354 and lateral deep heel hole 356, at this particular cross-section may be different from that of central deep heel hole 350 because the center points of medial deep heel hole 354 and lateral deep heel hole 356 are offset from the center point of central deep heel hole 350.

Figure 7:
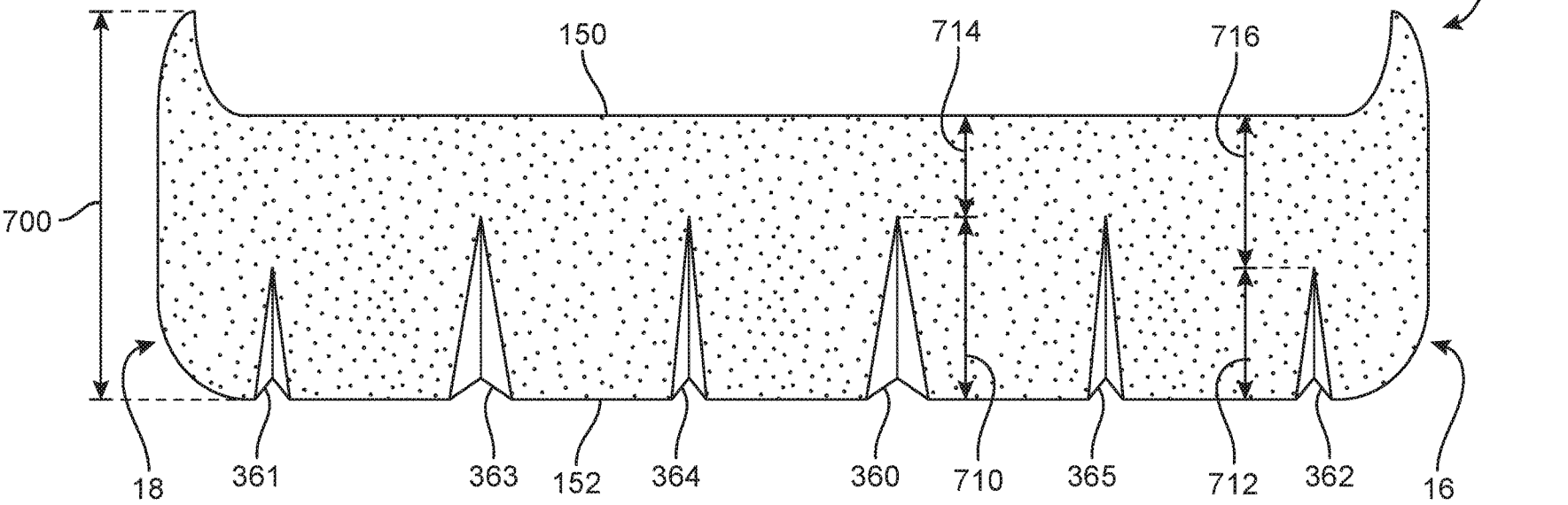
FIG. 7 is a cross-sectional view of an embodiment of a forefoot portion of the midsole component shown in FIG. 3 as taken along line 7-7.

Similar to heel portion 14, forefoot portion 10 may be designed for tunable performance characteristics. FIG. 7 is a cross-sectional view of the midsole of FIG. 3 taken along line 7-7 through forefoot portion 10 when midsole component 122 is not subject to any external forces. This section of midsole component 122 passes through six holes: a first deep forefoot hole 360, a second deep forefoot hole 363, a third deep forefoot hole 364, a fourth deep forefoot hole 365, a medial shallow forefoot hole 361, and a lateral shallow forefoot hole 362. First deep forefoot hole 360, second deep forefoot hole 363, third deep forefoot hole 364, and fourth deep forefoot hole 365 are arranged between medial side 18 and lateral side 16. Medial shallow forefoot hole 361 is positioned proximate medial side 18, and lateral shallow forefoot hole 362 is positioned proximate lateral side 16.

FIG. 7 clearly shows the depth penetration variation between the deep holes and the shallow holes in forefoot portion 10. First deep forefoot hole 360 extends from outer surface 152 into midsole forefoot thickness 700 a deep forefoot distance 710. Second deep forefoot hole 363, third deep forefoot hole 364, and fourth deep forefoot hole 365 each extend the same deep forefoot distance 710 into midsole forefoot thickness 700. Viewed another way, first deep forefoot hole 360 may terminate a first forefoot distance 714 from inner surface 150.

Medial shallow forefoot hole 361 extends from outer surface 152 into midsole forefoot thickness 700 a shallow distance 712. Lateral shallow forefoot hole 362 extends the same shallow distance 712 into midsole forefoot thickness 700. Viewed another way, medial shallow forefoot hole 361 may terminate a second forefoot distance 716 from inner surface 150.

Deep forefoot distance 710 is greater than shallow distance 712, so that the deep holes penetrate further into midsole forefoot thickness 700 than do the shallow holes. Midsole forefoot thickness 700 may be any thickness known in the art suitable for midsoles. Deep forefoot distance 710 may be any distance that terminates within midsole forefoot thickness 700, and, therefore, depends upon midsole forefoot thickness 700 and other factors such as the desired maximum expansion. Deep forefoot distance 710 may be selected for both auxetic expansion and durability; the termination point of deep forefoot distance 710 may be selected so that first forefoot distance 714 may yield sufficient material to withstand repeated expansion of first deep forefoot hole 360 without failure, such as breaking or material separation in the narrowest part of the midsole.

Figure 8:
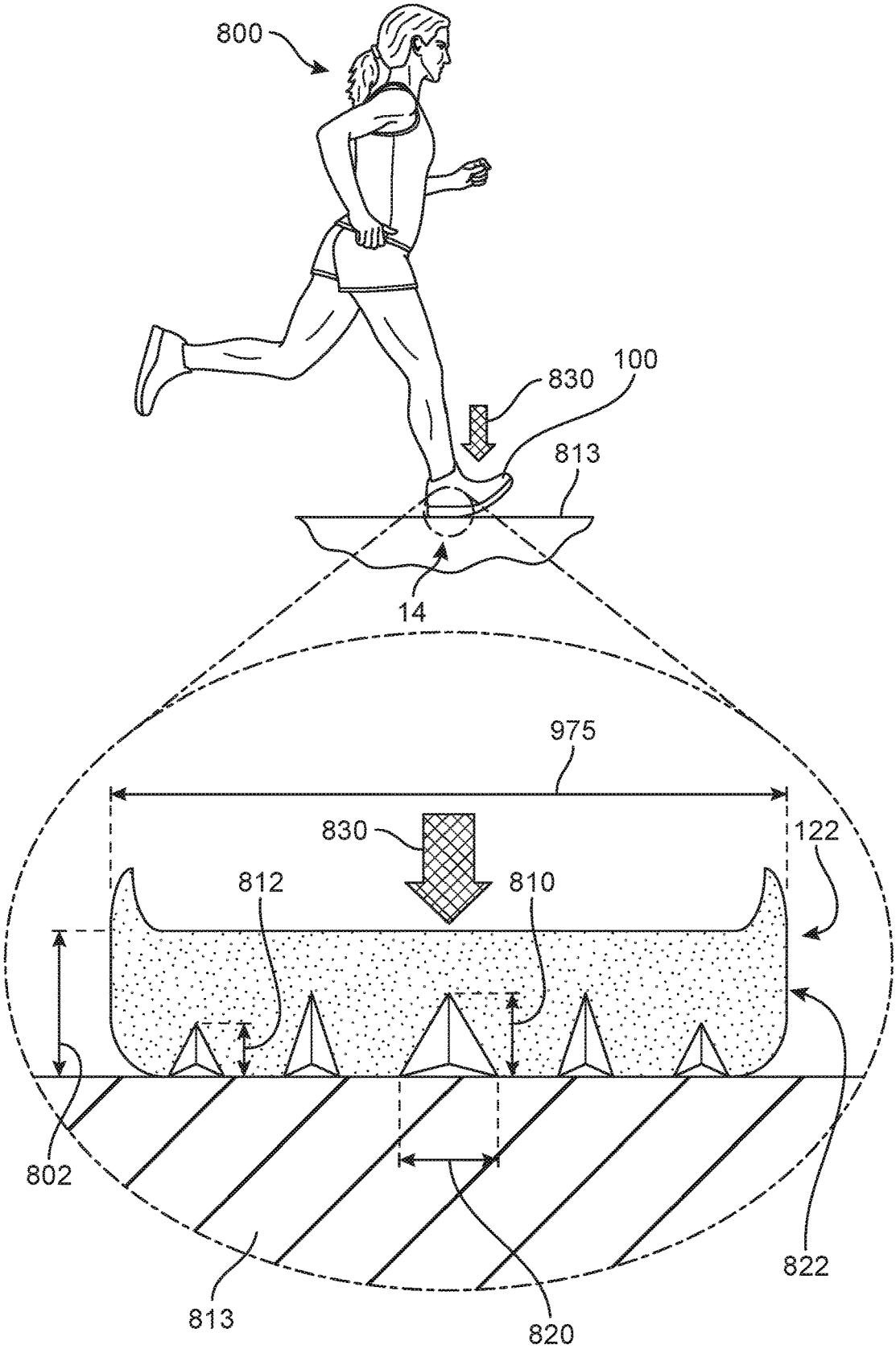
FIG. 8 is a schematic representation of the lateral expansion of an embodiment of a heel midsole with auxetic structures in response to a hard heel strike.
Figure 9:
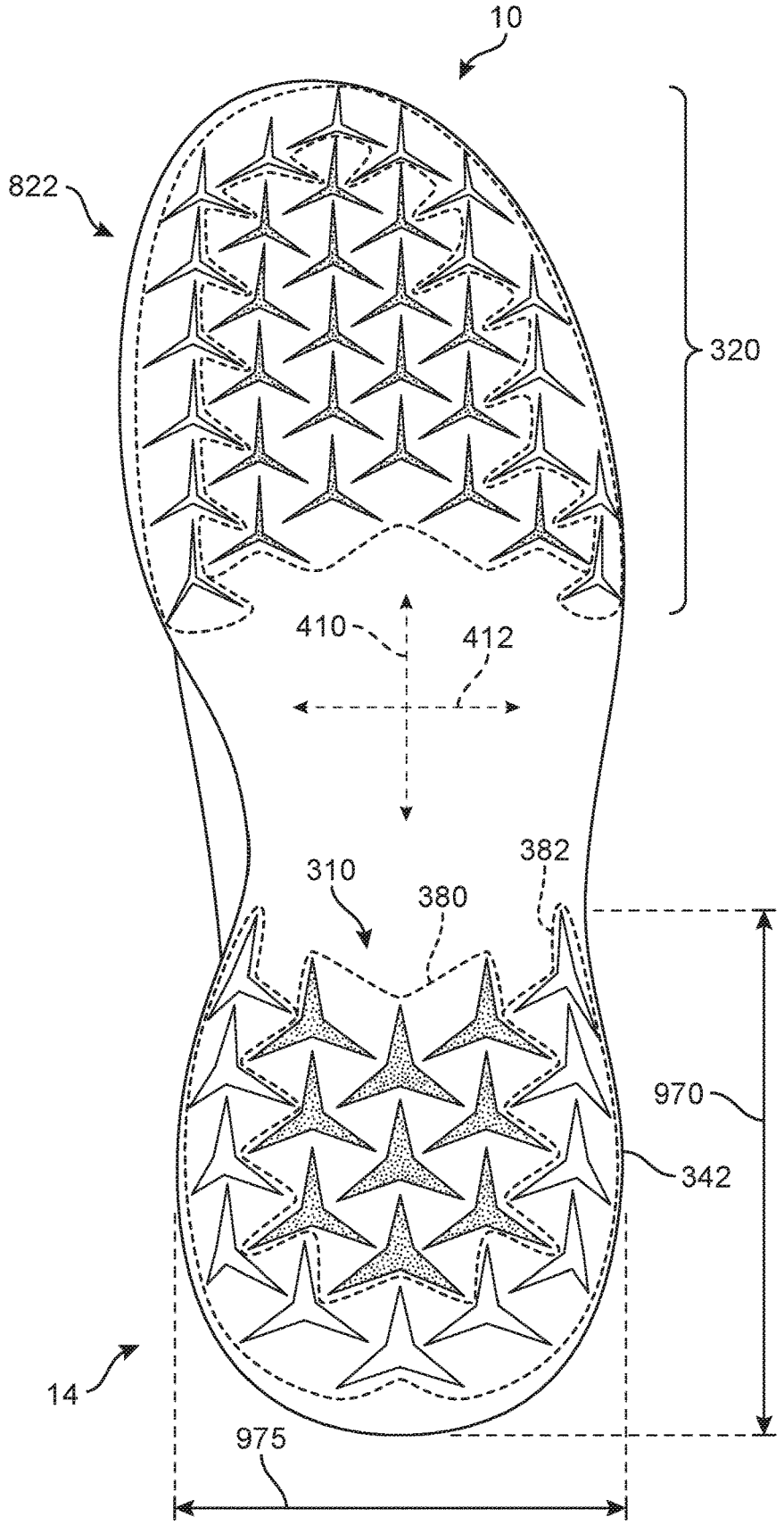
FIG. 9 is a schematic representation of the longitudinal and lateral expansion of the embodiment of a heel midsole with auxetic structures shown in FIG. 8 in response to a hard heel strike.

FIGS. 8-11 show how the same midsole with auxetic structures, midsole component 122, may have different cushioning and stability responses when impacted with forces of different magnitude. FIGS. 8 and 9 show how midsole component 122 may respond to a high magnitude impact, such as a hard heel strike. A first user 800 may run wearing an article of footwear like article of footwear 100 that incorporates a midsole like midsole component 122. First user 800 may impact a surface 813 such as the ground with a hard heel strike, which may impart a hard force 830 to midsole component 122. Midsole component 122 may expand auxetically to hard expanded state 822. In hard expanded state 822, at least one of the holes of heel portion 14 expands in an auxetic manner in response to hard force 830 to expand heel portion 14. As shown in FIGS. 8 and 9, the width of heel portion 14 expands to a hard force width 975 and the length of heel portion 14 expands to a hard force length 970. Hard force width 975 is greater than initial heel portion width 375 as shown in FIG. 3. Hard force length 970 is also greater than initial heel portion length 370 as shown in FIG. 3.

The total area of heel portion 14 increases in response to hard force 830. The increase in area is due to the expansion of the holes in both longitudinal direction 410 and lateral direction 412. As shown in FIG. 8, for example, the holes may take on an expanded deep hole width 820 and an expanded shallow hole width 812 in an auxetic manner as discussed above with respect to FIGS. 4 and 5. As such, an increase in length corresponds to an increase in width. In some embodiments, the material of midsole component 122 may compress in response to hard force 830 to locally reduce the thickness of midsole component 122 from initial midsole heel thickness 600 (shown in FIG. 6) to hard force thickness 802. Hard force thickness 802 may be less than initial midsole heel thickness 600, though in some embodiments, the energy of hard force 830 may be entirely absorbed by the expansion of the holes. As will be apparent to those of skill in the art, once hard force 830 is no longer being applied to midsole component 122, the holes in midsole may contract and midsole component 122 may return to the initial configuration shown in FIG. 3.

Figure 10:
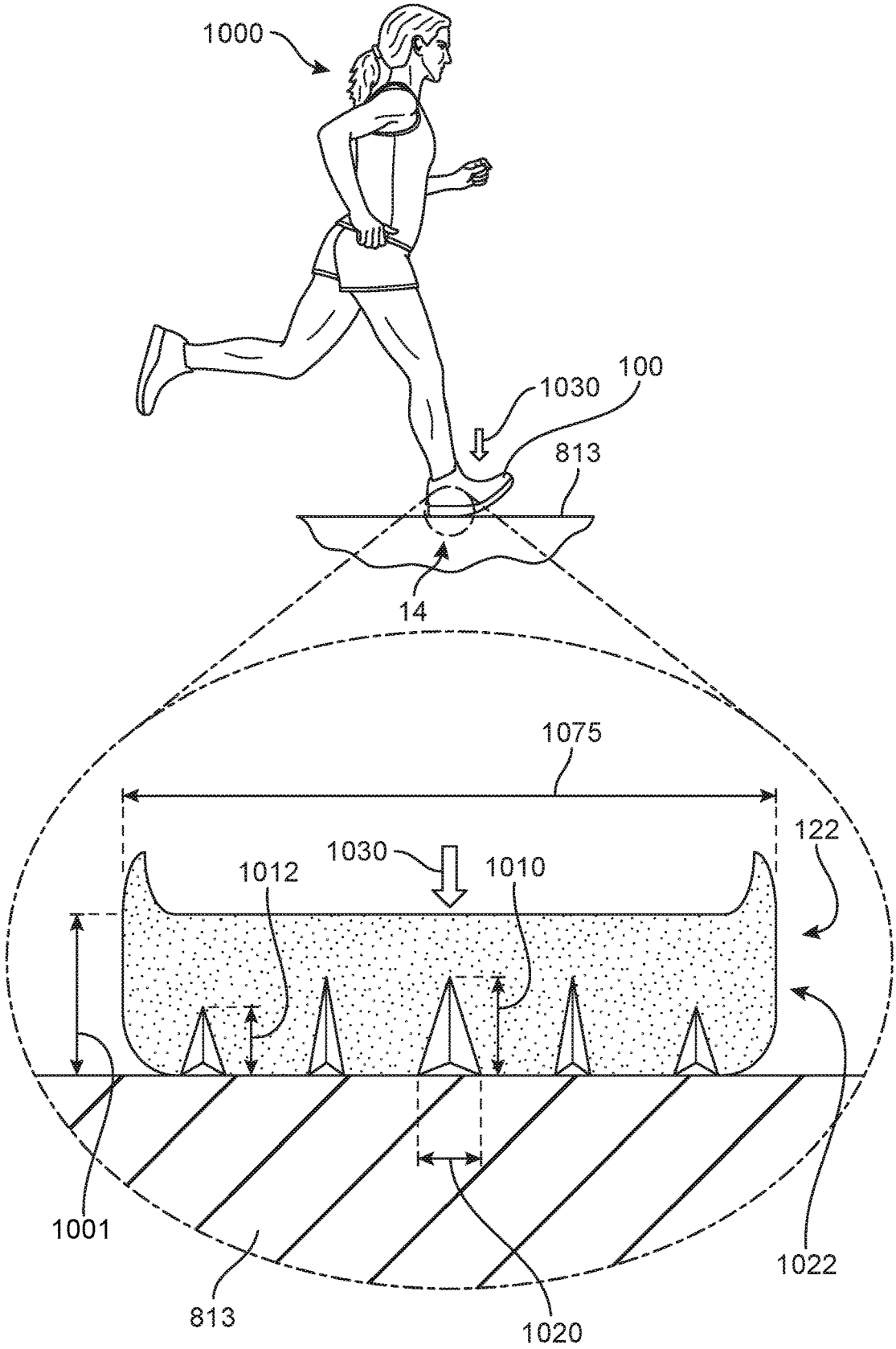
FIG. 10 is a schematic representation of the lateral expansion of an embodiment of a heel midsole with auxetic structures in response to a soft heel strike.
Figure 11:
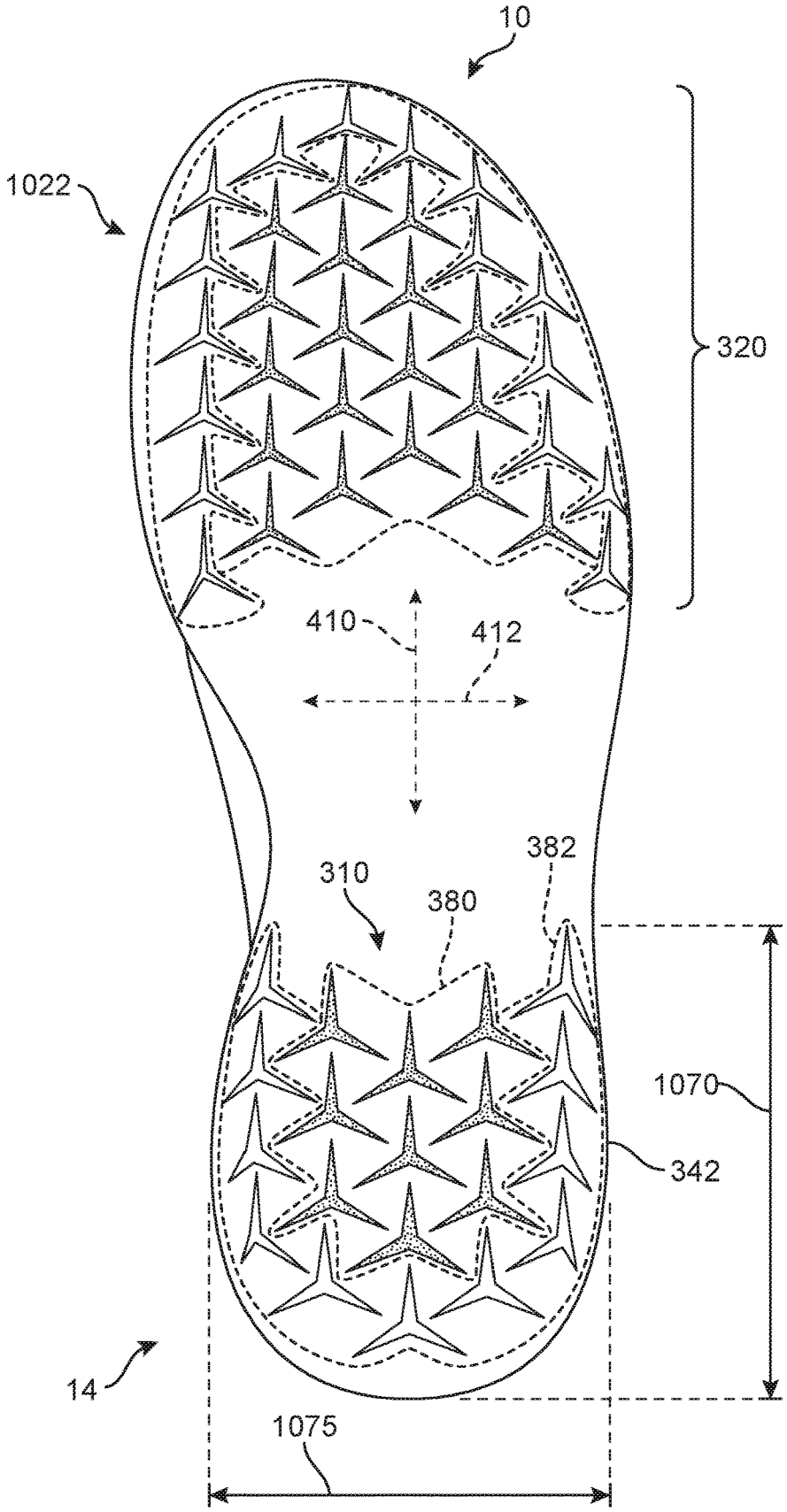
FIG. 11 is a schematic representation of the longitudinal and lateral expansion of the embodiment of a heel midsole with auxetic structures shown in FIG. 10 in response to a soft heel strike.

FIGS. 10 and 11 show how midsole component 122 may respond to a lower magnitude impact, such as a soft heel strike. A second user 1000 may run wearing an article of footwear like article of footwear 100 that incorporates a midsole like midsole component 122. Second user 1000 may impact surface 813 such as the ground with a softer heel strike than first user 800, which may impart a weak force 1030 to midsole component 122. Midsole component 122 may expand auxetically to weak expanded state 1022. In weak expanded state 1022, at least one of the holes of heel portion 14 expands in an auxetic manner in response to weak force 1030. As shown in FIGS. 10 and 11, the width of heel portion 14 expands to a weak force width 1075 and the length of heel portion 14 expands to a weak force length 1070. Weak force width 1075 is greater than initial heel portion width 375 as shown in FIG. 3, but less than hard force width 975 as shown in FIG. 9. Weak force length 1070 is also greater than initial heel portion length 370 as shown in FIG. 3, but less than hard force length 970 as shown in FIG. 9.

The total area of heel portion 14 increases in response to weak force 1030. The increase in area is due to the expansion of the holes in both longitudinal direction 410 and lateral direction 412. As shown in FIG. 10, for example, the holes may take on a weak expanded deep hole width 1020 and a weak expanded shallow hole width 1012 in an auxetic manner as discussed above with respect to FIGS. 4 and 5. As such, an increase in length corresponds to an increase in width. In some embodiments, the material of midsole component 122 may compress in response to weak force 1030 to locally reduce the thickness of midsole component 122 from initial midsole heel thickness 600 (shown in FIG. 6) to weak force thickness 1001. In some embodiments, weak force thickness 1001 may be less than initial midsole heel thickness 600 but greater than hard force thickness 802. In some embodiments, the energy of weak force 1030 may be entirely dissipated by the expansion of the holes. In such embodiments, weak force thickness 1001 may be the same as initial midsole heel thickness 600. As will be apparent to those of skill in the art, once weak force 1030 is no longer being applied to midsole component 122, the holes in midsole may contract and midsole component 122 may return to the initial configuration shown in FIG. 3.

Figure 12:
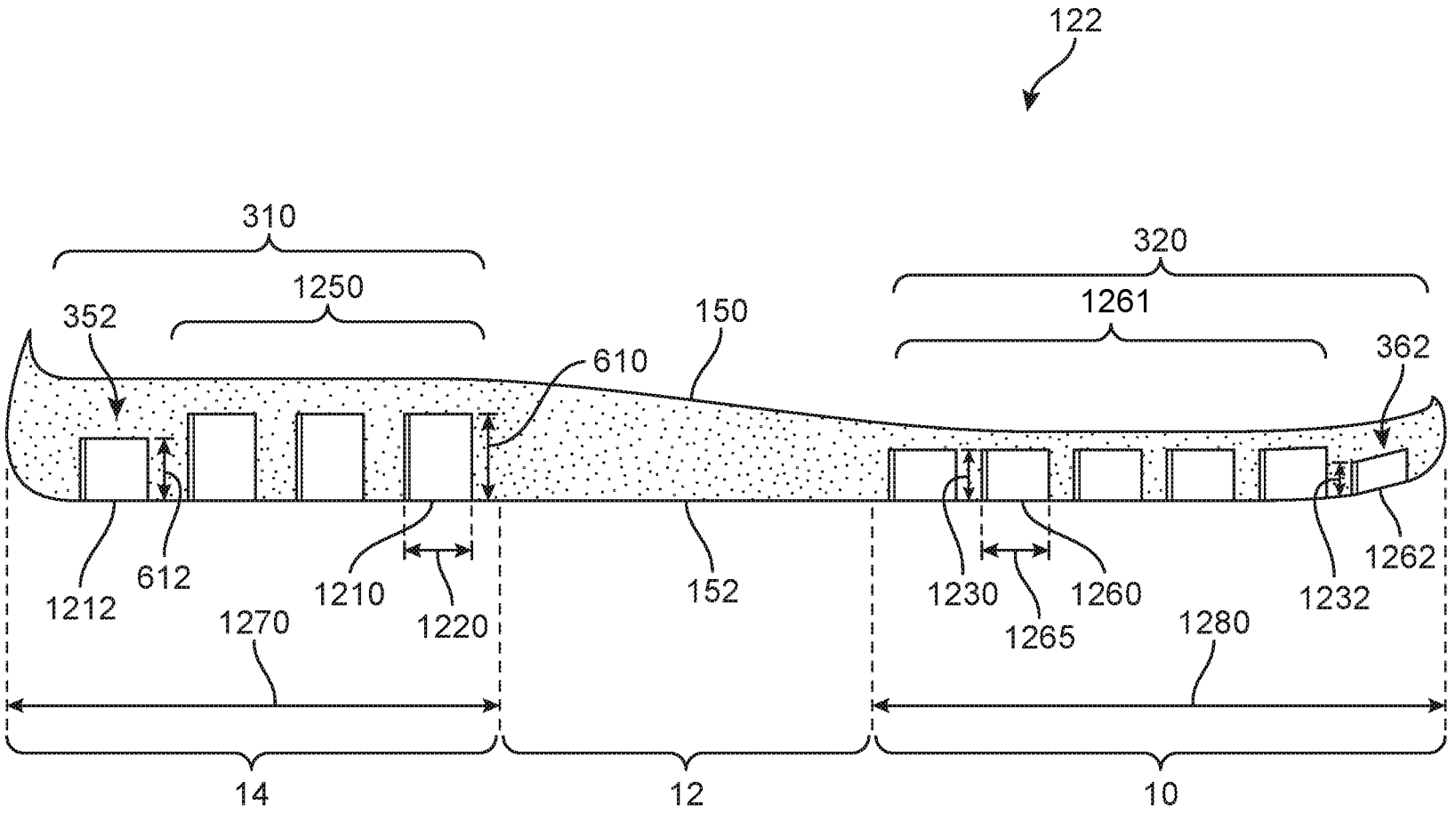
FIG. 12 is a schematic, longitudinal cross-sectional view of the midsole shown in FIG. 3 in a condition at rest.

As noted above, the pattern of blind holes on midsole component 122 may be distributed so that different portions of midsole component 122 have different performance characteristics. As shown in FIG. 3, forefoot portion 10 and heel portion 14 may have different patterns, types, and/or number of blind holes. FIG. 12 is a longitudinal cross-sectional view of midsole component 122 at a central lateral position between medial side 18 and lateral side 16 that shows the different numbers and depths of heel holes 310 and forefoot holes 320 in this embodiment.

As shown, both forefoot portion 10 and heel portion 14 have relatively deep holes and relatively shallow holes. For example, forefoot portion 10 in this embodiment includes plurality of deep forefoot holes 390 and plurality of shallow forefoot holes 392 (shown in FIG. 3). Similarly, heel portion 14 includes plurality of deep heel holes 380 and plurality of shallow heel holes 382 (shown in FIG. 3). The number of holes in forefoot portion 10 differs from the number of holes in heel portion 14. For example, in this embodiment, forefoot portion 10 includes five deep forefoot holes 1261 in this lateral position while heel portion 14 includes only three deep heel holes 1250. The different number of holes may be partially due to different sizes of forefoot portion 10 and heel portion 14. For example, in some embodiments, forefoot portion 10 may be larger than heel portion 14. In some embodiments, the patterns of auxetic holes may cover an entirety of forefoot portion 10 and an entirety of heel portion 14. Because the area of forefoot portion 10 may be greater than an area of heel portion 14, the number of auxetic holes disposed in forefoot portion 10 may be greater than the number of similar surface area auxetic holes disposed in heel portion 14. Further, as shown in FIG. 12, plurality of forefoot holes 320 may be smaller than heel holes 310. Either of these reasons may account for the different number of holes in forefoot portion 10 than in heel portion 14.

However, the number of holes in the different portions may be due to the intended tunable performance characteristics of the different portions. For example, heel portion 14 may be primarily designed to provide cushioning for harder impacts, such as heel strikes, while forefoot portion 10 may be primarily designed to provide stability when a foot rolls from a heel strike to push off from a surface for the next step. While both portions, heel portion 14 and forefoot portion 10, may include both cushioning and stability features, the dominant intended characteristic for a portion may control the pattern, type, and number of auxetic holes in the portion.

In addition to number, the sizes of the holes may differ between forefoot portion 10 and heel portion 14. As shown in FIG. 12, heel holes 310 are generally larger than forefoot holes 320. For example, first deep heel hole 1210 may extend from outer surface 152 into midsole component 122 to deep heel distance 610, while first deep forefoot hole 1260 may extend from outer surface 152 into midsole component 122 to deep forefoot distance 1230. In some embodiments, deep heel distance 610 may be greater than deep forefoot distance 1230. The different deep hole distances may be provided so that heel portion 14 may expand auxetically to a greater degree than forefoot portion 10. Consequently, in some embodiments, heel portion 14 may provide more cushioning than forefoot portion 10. Forefoot portion 10 may provide more stability and support than heel portion 14, even though the surface pattern of holes looks similar between the portions.

Figure 13:
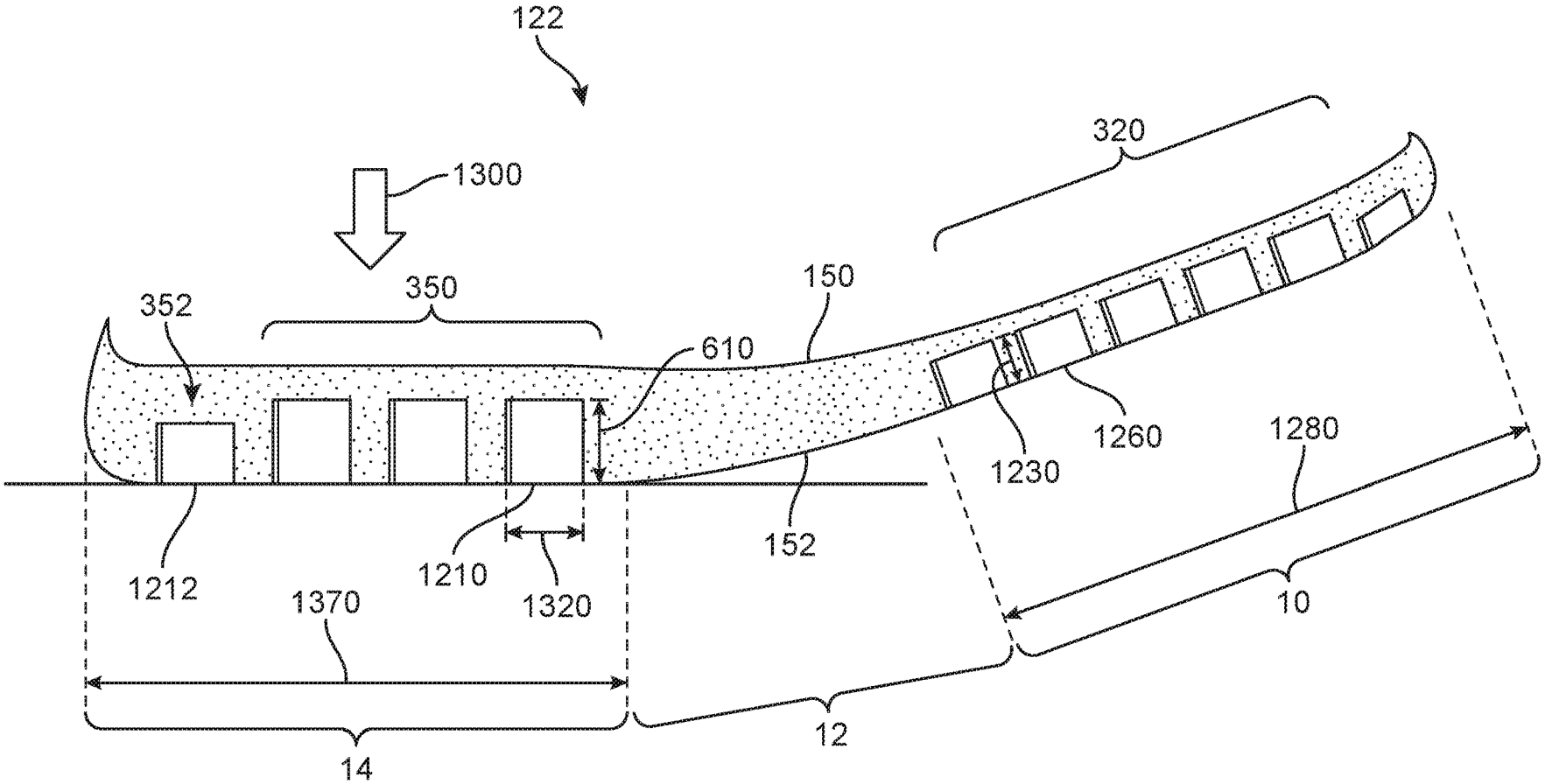
FIG. 13 is a schematic, longitudinal cross-sectional view of the midsole shown in FIG. 3 when subjected to a heel strike.
Figure 14:
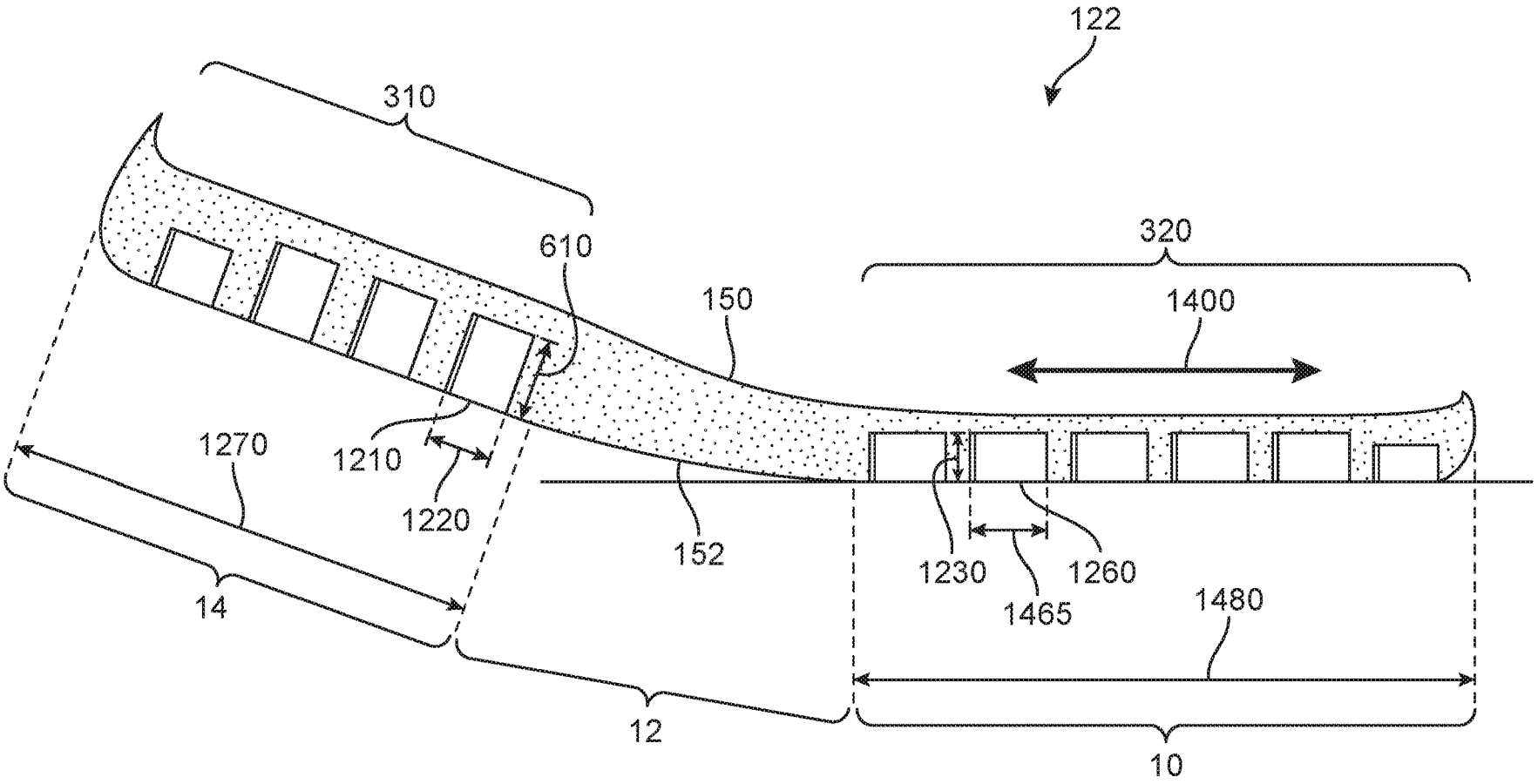
FIG. 14 is a schematic, longitudinal cross-sectional view of the midsole shown in FIG. 3 when subjected to a forefoot push-off force.

FIGS. 12-14 show how heel portion 14 and forefoot portion 10 react to the different types of forces to which those portions are subjected. As shown in FIG. 13, heel portion 14 may be subjected to a heel strike that imparts a heel force 1300 to heel portion 14. For the purposes of this example, only heel portion 14 is subjected to heel force 1300; forefoot portion 10 is lifted away from the impact surface.

Heel force 1300 causes heel holes 310 (shown in FIG. 3) to expand. Each hole, such as first deep heel hole 1210, may increase in length. For example, first deep heel hole 1210 may have an initial deep heel hole length 1220. Under the pressure of heel force 1300, initial deep heel hole length 1220 increases to expanded deep heel hole length 1320. In the embodiment shown in FIG. 13, the expansion of the holes corresponds to an overall expansion of heel portion 14, shown in FIG. 13 as an increase in the length of heel portion 14. As shown in FIG. 12, heel portion 14 has an initial heel length 1270. Once auxetically expanded, as shown in FIG. 13, heel portion 14 has an expanded auxetic length 1370, which is greater than initial heel length 1270. As will be apparent to those of skill in the art, while not shown, heel portion 14 of midsole component 122 may also expand in a medial-to-lateral direction, as discussed above. Forefoot portion 10 remains unchanged in this embodiment, though forefoot portion 10 may expand slightly in some embodiments.

Heel holes 310 may be selected to provide cushioning to impacts like heel force 1300 from a heel strike. As discussed above, heel holes 310 generally extend further into midsole component 122 than do forefoot holes 320. The size of heel holes 310 allows heel holes 310 to expand more than forefoot holes 320, and, consequently, to provide more cushioning more than forefoot holes 320. Additionally, when auxetically expanded, heel portion 14 will expand in both a longitudinal direction and a lateral direction as shown in FIG. 9. The large heel surface area can also assist in the stability of heel portion 14 by increasing traction between heel portion 14 and the impact surface so that heel portion 14 is less likely to slip.

As shown in FIG. 14, forefoot portion 10 may be subjected to a rolling push-off that imparts a longitudinal force 1400 to forefoot portion 10. The rolling motion of the foot stretches forefoot portion 10. For the purposes of this example, only forefoot portion 10 is subjected to longitudinal force 1400; heel portion 14 is lifted away from the impact surface (not shown).

Longitudinal force 1400 causes forefoot holes 320 to expand. Each hole, such as first deep forefoot hole 1260, may increase in length. For example, first deep forefoot hole

1260 may have an initial deep heel hole length 1220. Under the pressure of longitudinal force 1400, initial deep forefoot hole length 1265 increases to expanded deep forefoot hole length 1465. In the embodiment shown in FIG. 14, the expansion of the holes corresponds to an overall expansion of forefoot portion 10, shown in FIG. 14 as an increase in the length of forefoot portion 10. As shown in FIG. 12, forefoot portion 10 has an initial forefoot length 1280. Once auxetically expanded, as shown in FIG. 14, forefoot portion 10 has an expanded auxetic length 1480, which is greater than initial forefoot length 1280. As will be apparent to those of skill in the art, while not shown, forefoot portion 10 of midsole component 122 may also auxetically expand in a medial-to-lateral direction, as discussed above. Heel portion 14 remains unchanged in this embodiment. In other embodiments, heel portion 14 may expand slightly.

Forefoot holes 320 may be selected to provide stability when subjected to forces like rolling longitudinal force 1400. As discussed above, forefoot holes 320 generally do not extend as far into midsole component 122 as heel holes 310. The relatively shallow size of forefoot holes 320 allows forefoot holes 320 to resist expansion more than heel holes 310, and, consequently, to provide more of a countering force against rolling in an unintended manner. Additionally, when auxetically expanded, forefoot portion 10 will expand in both a longitudinal direction and a lateral direction as shown in FIG. 11. The larger surface area can further assist in stability of forefoot portion 10 by providing a larger platform for the forefoot of a user.

As noted above, the cushioning elements described herein may be utilized with various components or articles. For example, the degree of elasticity, cushioning, and flexibility of a sole component such as a sole member can be important factors associated with comfort and injury prevention for an article of footwear. FIGS. 15-20 depict an embodiment of a method of designing a customized sole member for an article of footwear. Additional embodiments of methods of designing a customized sole member may be found in U.S. Patent Publication Number 2016/0345667 to Kohatsu, currently U.S. Ser. No. 14/722,826, titled "Article of Footwear Comprising a Sole Member with Geometric Patterns", and filed on May 27, 2015; the entirety of this application is incorporated herein by reference.

Figure 15:
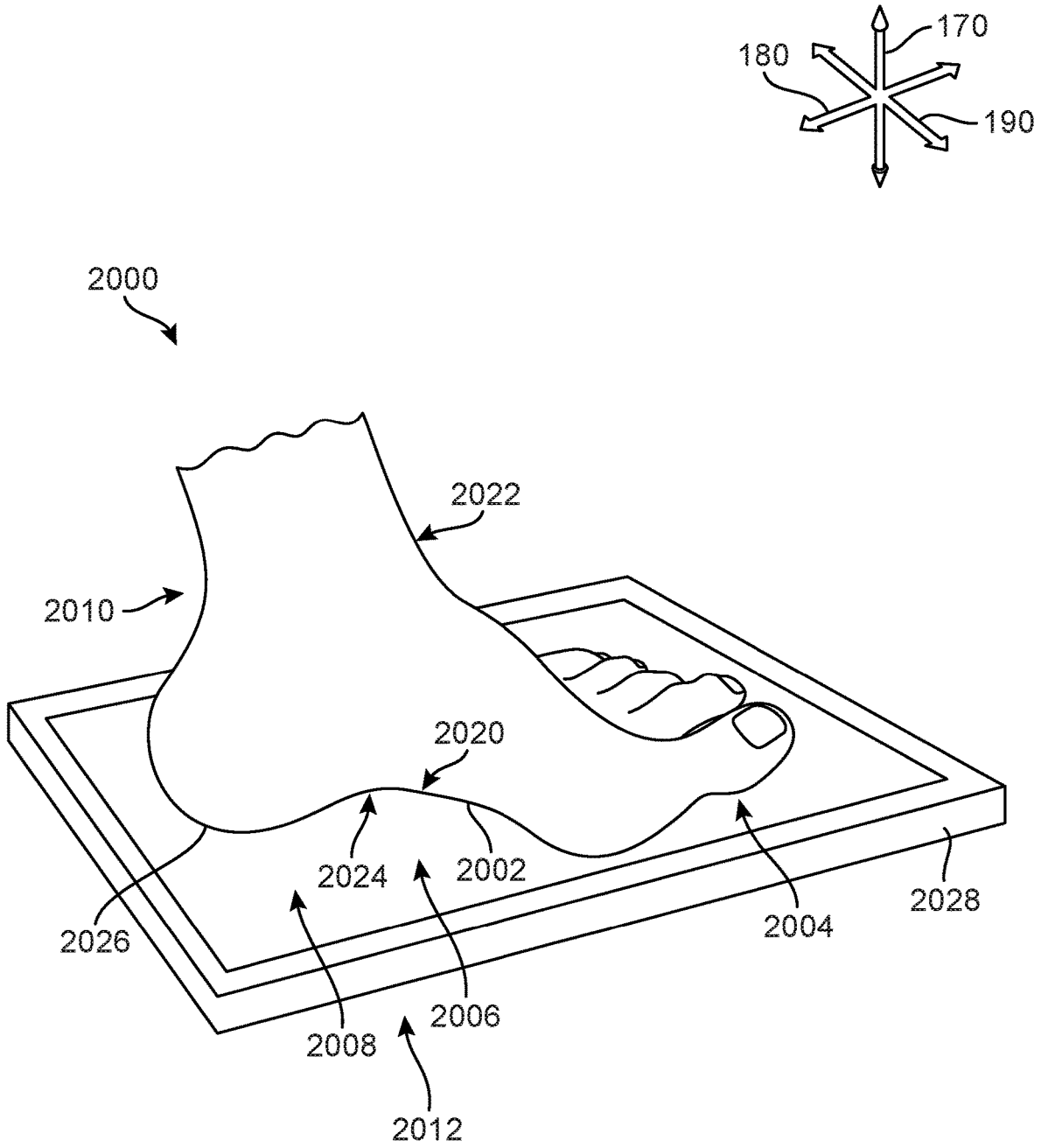
FIG. 15 illustrates an embodiment of the use of a device for obtaining three-dimensional foot data.

FIG. 15 shows the three-dimensional shape of plantar surface 2002 of a foot 2000 being measured using a data collection apparatus 2028. In some cases, data collection apparatus 2028 can be a force platform. In other cases, data collection apparatus 2028 can comprise one of the commercially available systems for measuring plantar pressure (e.g., Emed sensor platform, Pedar insole system, F-Scan system, Musgrave footprint system, etc.). Plantar pressure measurement systems can provide a means of obtaining specialized information regarding a foot that can be used to customize footwear for individuals. In some embodiments, the magnitude of pressure can be determined by dividing the measured force by the known area of the sensor or sensors evoked while the foot was in contact with the supporting surface in some embodiments.

For purposes of reference, foot 2000, representations of foot 2000, components associated with foot 2000 (such as an article of footwear, an upper, a sole member, a computer-aided design of foot 2000, and other components/representations) may be divided into different portions. Foot 2000 may include a forefoot portion 2004, a midfoot portion 2006 and a heel portion 2008. Forefoot portion 2004 may be generally associated with the toes and joints connecting the metatarsals with the phalanges. Midfoot portion 2006 may be generally associated with the metatarsals of a foot. Heel portion 2008 may be generally associated with the heel of a foot, including the calcaneus bone. In addition, foot 2000 may include a lateral side 2010 and a medial side 2012. In particular, lateral side 2010 and medial side 2012 may be associated with opposing sides of foot 2000. Furthermore, both lateral side 2010 and medial side 2012 may extend through forefoot portion 2004, midfoot portion 2006, and heel portion 2008. It will be understood that forefoot portion 2004, midfoot portion 2006, and heel portion 2008 are only intended for purposes of description and are not intended to demarcate precise portions of foot 2000. Likewise, lateral side 2010 and medial side 2012 are intended to represent generally two sides of foot 2000, rather than precisely demarcating foot 2000 into two halves.

Figure 16:
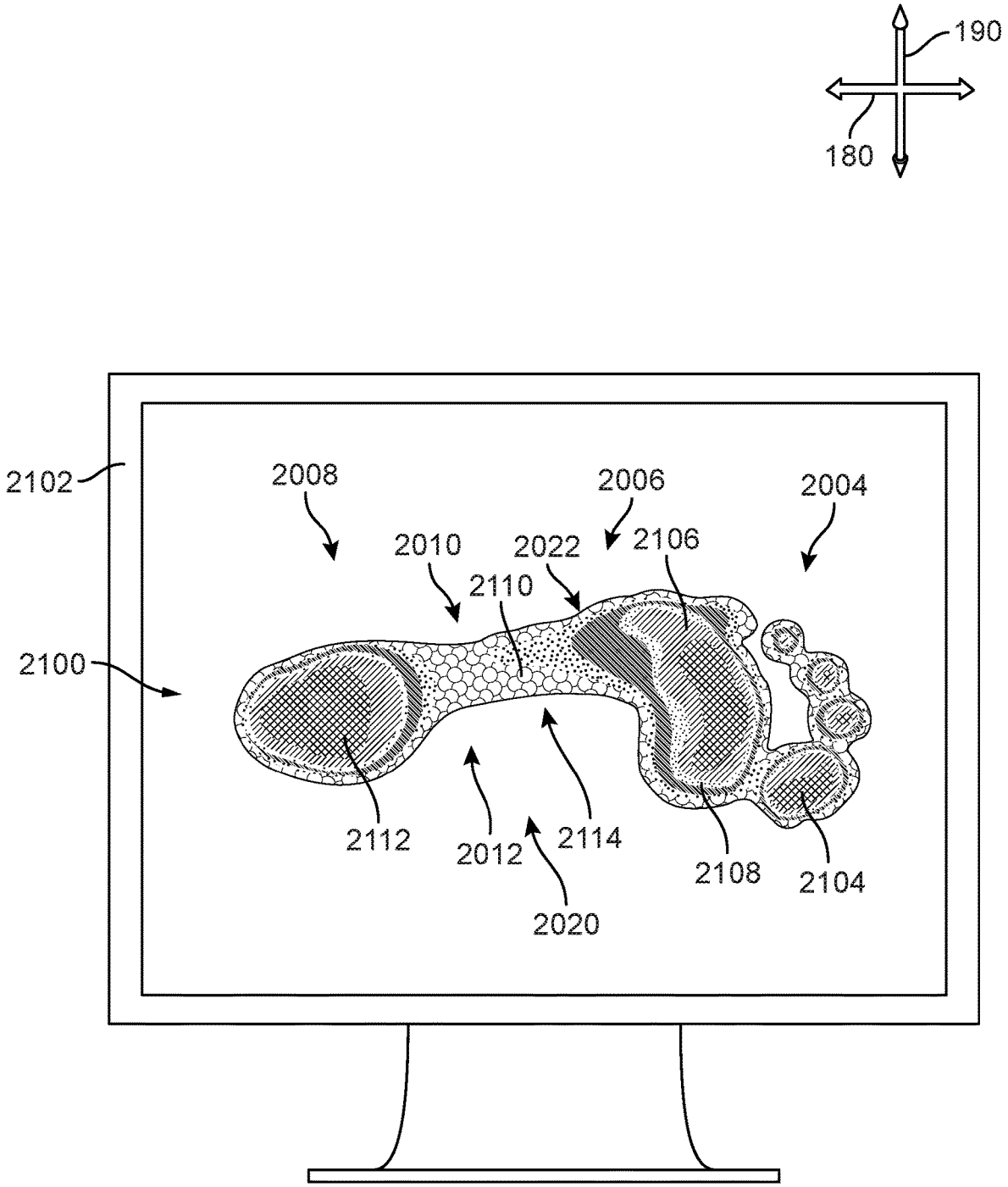
FIG. 16 schematically illustrates an embodiment of a virtual image of digitized three-dimensional foot data.

Furthermore, in the examples depicted in FIGS. 15 and 16, foot 2000 and/or a virtual scan 2100 of a foot may include a medial arch area 2020, associated with an upward curve along medial side 2012 of midfoot portion 2006, and a lateral arch area 2022, associated with an upward curve along lateral side 2010 of midfoot portion 2006. The portion corresponding to lateral arch area 2022 is best seen in FIG. 16, which illustrates a computer screen or virtual image of digitized three-dimensional foot data. As described below, the curvature of medial arch area 2020 and lateral arch area 2022 may vary from one foot to another. In addition, foot 2000 includes a transverse arch 2024 that extends in a direction generally aligned with lateral axis 190 near forefoot portion 2004 along plantar surface 2002. Foot 2000 also includes a heel prominence 2026, which is the prominence located in heel portion 2008 of foot 2000. As shown in FIG. 15, foot 2000 is illustrated as a left foot; however, it should be understood that the following description may equally apply to a mirror image of a foot or, in other words, a right foot.

Although the embodiments throughout this detailed description depict components configured for use in athletic articles of footwear, in other embodiments, the components may be configured to be used for various other kinds of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports related footwear, including, but not limited to, slippers, sandals, high-heeled footwear, loafers as well as any other kinds of footwear.

Components associated with an article of footwear are generally made to fit various sizes of feet. In the embodiments shown, the various articles are configured with approximately the same footwear size. In different embodiments, the components could be configured with any footwear sizes, including any conventional sizes for footwear known in the art. In some embodiments, an article of footwear may be designed to fit the feet of a child. In other embodiments, an article of footwear may be designed to fit the feet of an adult. Still, in other embodiments, an article of footwear may be designed to fit the feet of a man or a woman.

Referring to FIGS. 15 and 16, a first step of the present method is to collect data related to foot 2000, such as using a barefoot pressure measurement or other data, from the foot being measured on data collection apparatus 2028. Data collection apparatus 2028 may include provisions for capturing information about an individual's feet. Specifically, in some embodiments, data collection apparatus 2028 may include provisions to capture geometric information about one or more feet. This geometric information can include size (e.g., length, width, and/or height) as well as three-dimensional information corresponding to the customer's feet (e.g., forefoot geometry, midfoot geometry, heel geometry, and ankle geometry). In at least one embodiment, the captured geometric information for a customer's foot can be used to generate a three-dimensional model of the foot for use in later stages of manufacturing. In particular, the customized foot information can include at least the width and length of the foot. In some cases, the customized foot information may include information about the three-dimensional foot geometry. Customized foot information can be used to create a three-dimensional model of the foot. Embodiments may include any other provisions for capturing customized foot information. The present embodiments could make use of any of the methods and systems for forming an upper disclosed in Bruce, U.S. Patent Publication Number 2016/0166011 (now U.S. patent application Ser. No. 14/565,582, filed Dec. 10, 2014), titled "Portable Manufacturing System for Articles of Footwear," the entirety of which is hereby incorporated by reference.

Some embodiments could use any of the systems, devices, and methods for imaging a foot as disclosed in Leedy et al., U.S. Patent Publication Number 2013/0258085, published Oct. 3, 2013, and titled "Foot Imaging and Measurement Apparatus," (previously U.S. patent application Ser. No. 13/433,463, filed Mar. 29, 2012), the entirety of which is hereby incorporated by reference.

In FIG. 16, a screen 2102 displays virtual scan 2100 of plantar pressure distributions for the foot of FIG. 15. Virtual scan 2100 may provide a measured foot image or representation, including various distinct portions to indicate the pressures applied or experienced by foot 2000 over its plantar surface 2002, as shown in FIG. 15. In one example, pressures can include a first pressure area 2104, a second pressure area 2106, a third pressure area 2108, a fourth pressure area 2110, and a fifth pressure area 2112. An additional pressure area 2114 is indicated where plantar surface 2002 did not make an impressionable contact with the surface of data collection apparatus 2028. In some embodiments, colors (not shown in FIG. 16) can be included in virtual scan 2100 to more readily distinguish variations within the measured pressure data. It should be noted that in other embodiments, different, fewer, or more pressure areas may be measured or indicated.

As seen in FIG. 16, in some embodiments, the data collected may include virtual scan 2100 of foot 2000. In some embodiments, virtual scan 2100 may be used to assess the three-dimensional shape and obtain digital data in a two-dimensional or a three-dimensional reference frame. In other embodiments, virtual scan 2100 can provide a baseline shape for a footwear component. In one embodiment, three-dimensional scanned images may be used to measure the overall shape of a person's feet, and obtain two-dimensional measurements such as an outline, length, and width of foot 2000. Obtaining foot geometry can establish a baseline record for the person in one embodiment. In some embodiments, other input may also be provided to supplement information regarding the person being measured. In different embodiments, additional data such as toe height information may also be obtained. In other embodiments, plaster casts of a person's foot may be taken and digitized. Additionally, other digital or imaging techniques that may be employed to capture two- and three-dimensional foot shape and profile can be used to construct and/or supplement virtual scan 2100. In other embodiments, the person whose foot is being measured may provide answers to questions describing the person's physical characteristics, limitations, preferences, and/or personal lifestyle, which may impact design of the various parts described herein.

Figure 17:
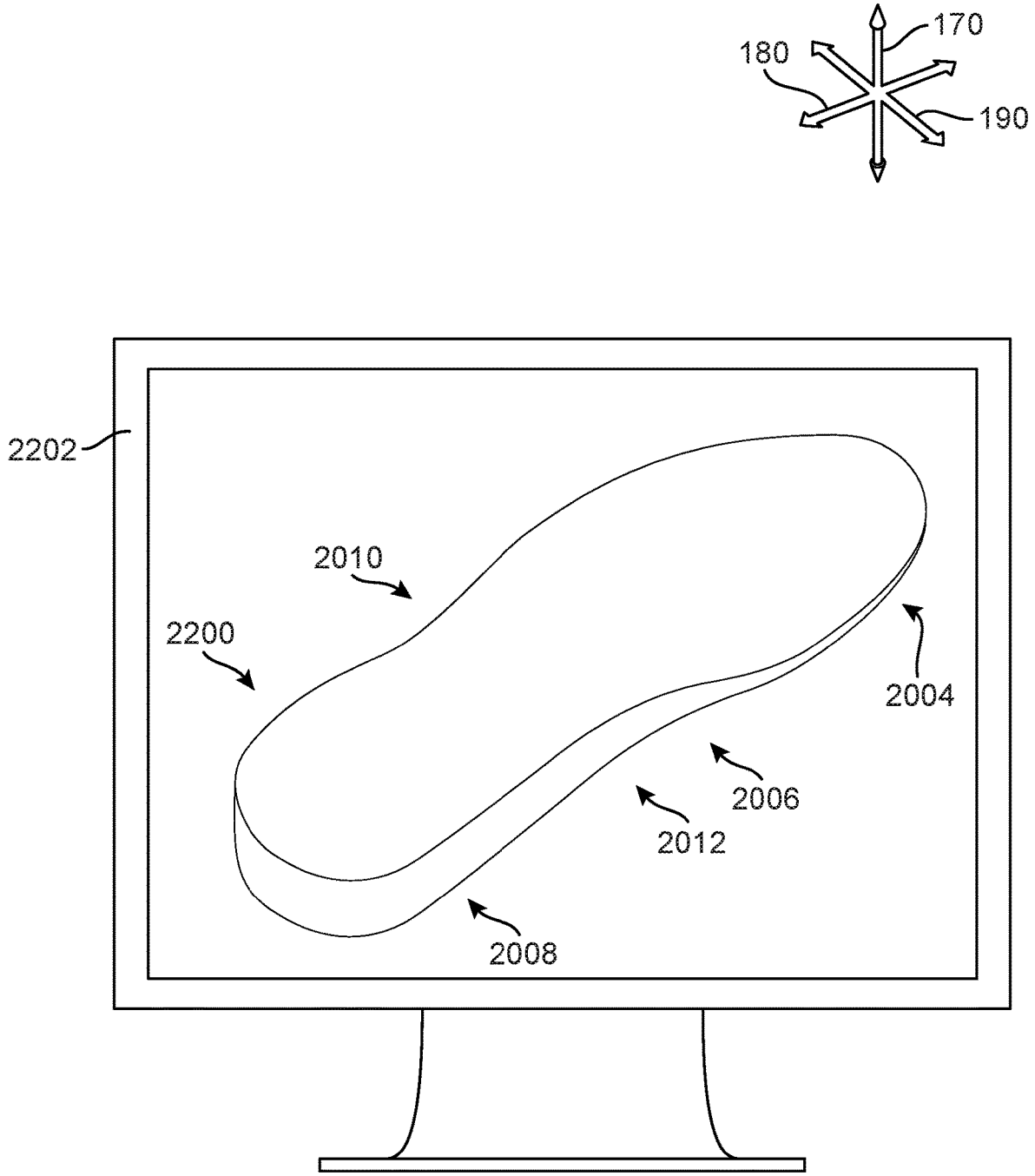
FIG. 17 schematically illustrates an embodiment of a virtual image of a template for a sole structure.
Figure 18:
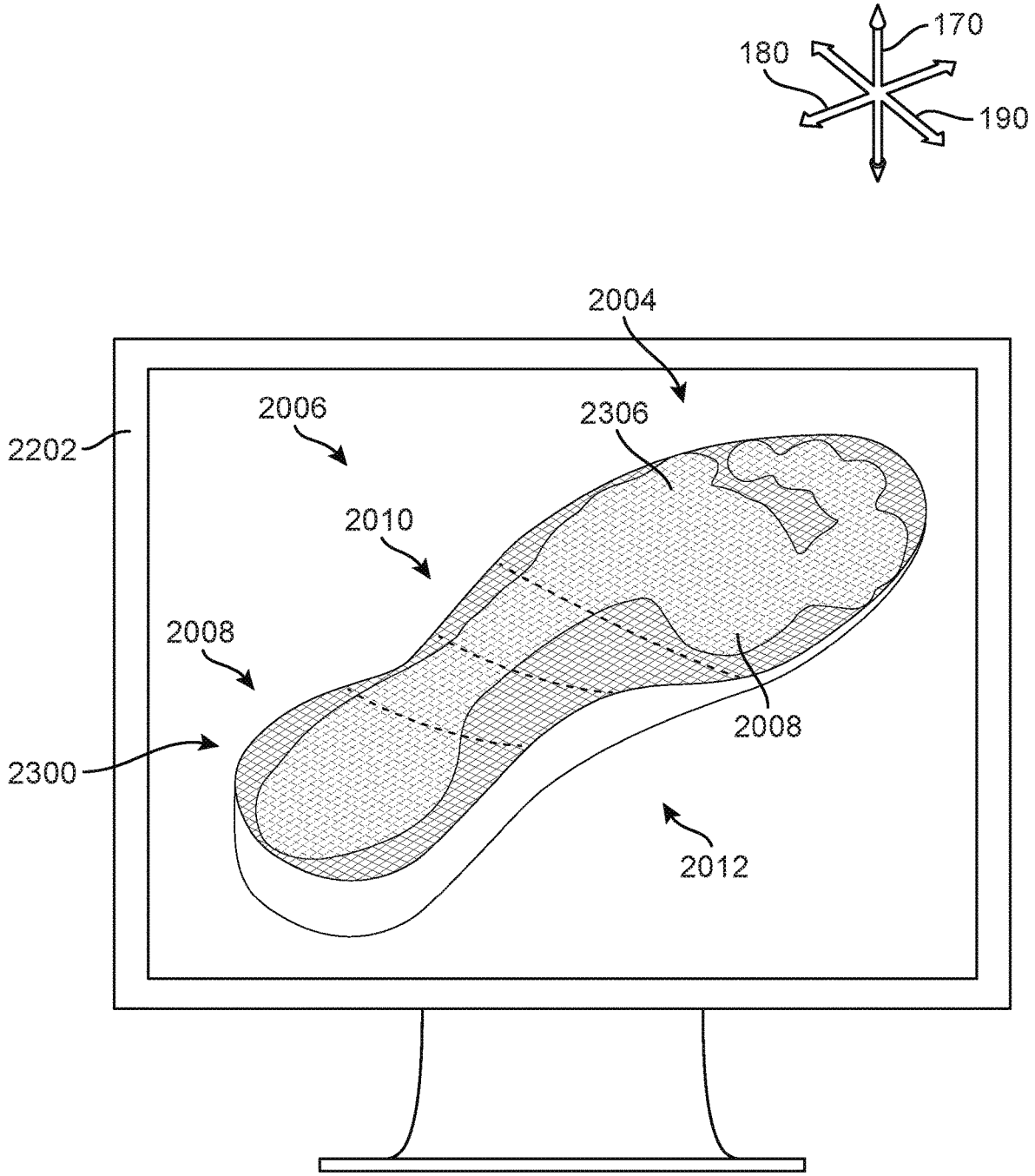
FIG. 18 schematically illustrates an embodiment of a virtual image of a customized sole structure.

In different embodiments, a sole member may provide one or more functions for an article of footwear. In FIG. 17, an image of a template of a sole member 2200 is displayed on a screen 2202. In some embodiments, sole member 2200 may attenuate ground reaction forces when compressed between the foot and the ground during walking, running, or other ambulatory activities. The configuration of sole member 2200 may vary significantly in different embodiments to include a variety of conventional or non-conventional structures. In some cases, the configuration of sole member 2200 can be selected or customized according to one or more types of ground surfaces on which sole member 2200 may be used. Examples of ground surfaces include, but are not limited to, natural turf, synthetic turf, dirt, as well as other surfaces.

Upon obtaining measurements of foot 2000 (see FIG. 15), sole member 2200 may be adjusted or altered in different embodiments. As seen in the virtual representation depicted in FIG. 18, using the data collected from the steps above, a first custom sole 2300 may be designed. In some embodiments, the design may utilize an application of an integrated computer-aided design such as a computer-automated manufacturing (CAD-CAM) process. Sole member 2200, or any other template previously selected, may be provided as an input to the computer design program. In one embodiment, the three-dimensional foot shape data from virtual scan 2100 in FIG. 16 is also provided to the program.

In different embodiments, virtual scan 2100 may provide information regarding foot shape and pressure to allow the appropriate fit and comfort within the article of footwear. The information may be used to form first custom sole 2300. In some embodiments, data from virtual scan 2100 may be superimposed or otherwise incorporated into the template of sole member 2200 (see FIGS. 16 and 22). For example, there may be a process of aligning the data representing the plantar pressures of foot 2000 with sole member 2200 and generating a partial or complete design of first custom sole 2300. In one embodiment, pressure contour lines 2306 may be generated during the design of first custom sole 2300. The pressure distribution may be adjusted to a "best-fit" position based upon user input in some embodiments. Once the distribution is finalized, a resiliency profile may be created. For purposes of this disclosure, a resiliency profile is a personalized pressure distribution for a user that may include the data collected during the steps described above. In some embodiments, the resiliency profile may be utilized in the production of first custom sole 2300. Thus, in one embodiment, after the resiliency profile comprising an individual's plantar pressure distributions is aligned with the template of sole member 2200, a customized sole member may be formed or manufactured.

It should be understood that, in different embodiments, the design of a sole member may include various modifications. Customized modifications may provide individual users with a wider range of comfort and fit. For example, different users may have differences in the height of the arch of foot 2000. As described above, foot 2000 may include multiple arches. Generally, the arch is a raised curve on the bottom surface of foot 2000. When the tendons of foot 2000 pull a normal amount, foot 2000 generally forms a moderate or normal arch. However, when tendons do not pull together properly, there may be little or no arch. This is called "flat foot" or fallen arch. Over-pronation of a foot may be common for those with flat feet. The framework of a foot can collapse, causing the foot to flatten and adding stress to other parts of the foot. Individuals with flat feet may need orthotics to control the flattening of the foot. Moreover, the opposite may also occur, though high foot arches are less common than flat feet. Without adequate support, highly arched feet tend to be painful because more stress is placed on the section of the foot between the ankle and toes. This condition can make it difficult to fit into shoes. Individuals who have high arches usually need foot support. It should be noted that such variations in arch height are one of many possible examples of customized foot geometry that may be incorporated into a design.

Figure 19:
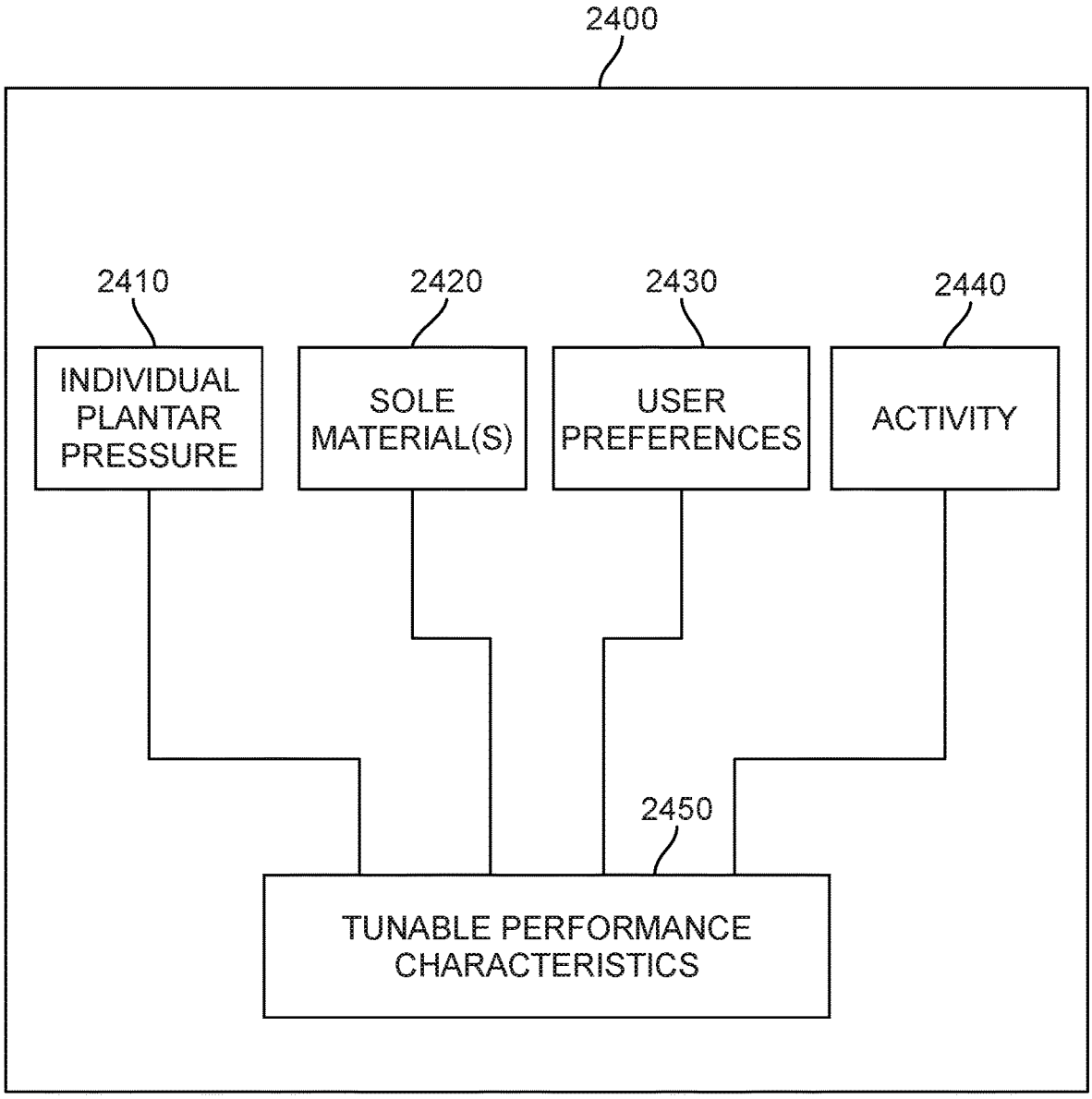
FIG. 19 is an embodiment of an influence diagram.

Referring to FIG. 19, an embodiment of an influence diagram 2400 is depicted. Influence diagram 2400 reflects some of the factors or variables that can be considered, incorporated, and/or used during the generation of the resiliency profile, permitting customization of tunable performance characteristics 2450 of a sole member. Tunable performance characteristics may include but are not limited to cushioning, traction, stability, and support. For example, a first factor 2410 includes an individual's measured plantar pressure for each foot, which was discussed above with respect to FIGS. 20-21. In addition, a second factor 2420 may include the materials that will be used to form the custom sole member. Third factor 2430 can be the individual user's own personal preferences regarding the type or level of cushioning desired. Fourth factor 2440 may be the activity or sport that the user will be generally engaging in while using the custom sole member. In some cases, the sole member can be designed or tailored to provide special cushioning in areas or portions of the sole member that typically experience more force or pressure from the foot during specific activities. Thus, in some embodiments, one or more of these factors can contribute to tunable performance characteristics 2450 of a sole member. It should be understood that influence diagram 2400 is provided as an example, and many other factors not listed here may be included in other embodiments. Furthermore, one or more factors listed in influence diagram 2400 may be removed from consideration depending on the desired output or the goal of the custom sole member.

Once a design has been generated, as with first custom sole 2300, the sole member may be manufactured. In some embodiments, the modifications may include portions of the sole member with apertures 2050 disposed along different portions of the sole member. In some embodiments, a sole member can be molded in a manner that creates apertures in the sole member. An article of footwear including apertures can be formed in any manner. In some embodiments, apertures can be created in a sole member using any known methods of cutting or drilling. For example, in one embodiment, apertures can be created using laser cutting techniques. Specifically, in some cases, a laser can be used to remove material from a sole member in a manner that forms apertures in the sole member. In another embodiment, a hot knife process could be used for forming apertures in a sole member. Examples of methods for forming apertures on a sole member are disclosed in McDonald, U.S. Pat. No. 7,607,241, issued Oct. 27, 2009, titled "Article of Footwear with an Articulated Sole Structure," (previously U.S. patent application Ser. No. 11/869,604, filed Oct. 9, 2007), the entirety of which is hereby incorporated by reference.

In other embodiments, however, any other type of cutting method can be used for forming apertures. Furthermore, in some cases, two or more different techniques can be used for forming apertures. As an example, in another embodiment, apertures disposed on a side surface of a sole member can be formed using laser cutting, while apertures on a lower surface of the sole member could be formed during a molding process. Still further, different types of techniques could be used according to the material used for a sole member. For example, laser cutting may be used in cases where the sole member is made of a foam material.

Figure 20:
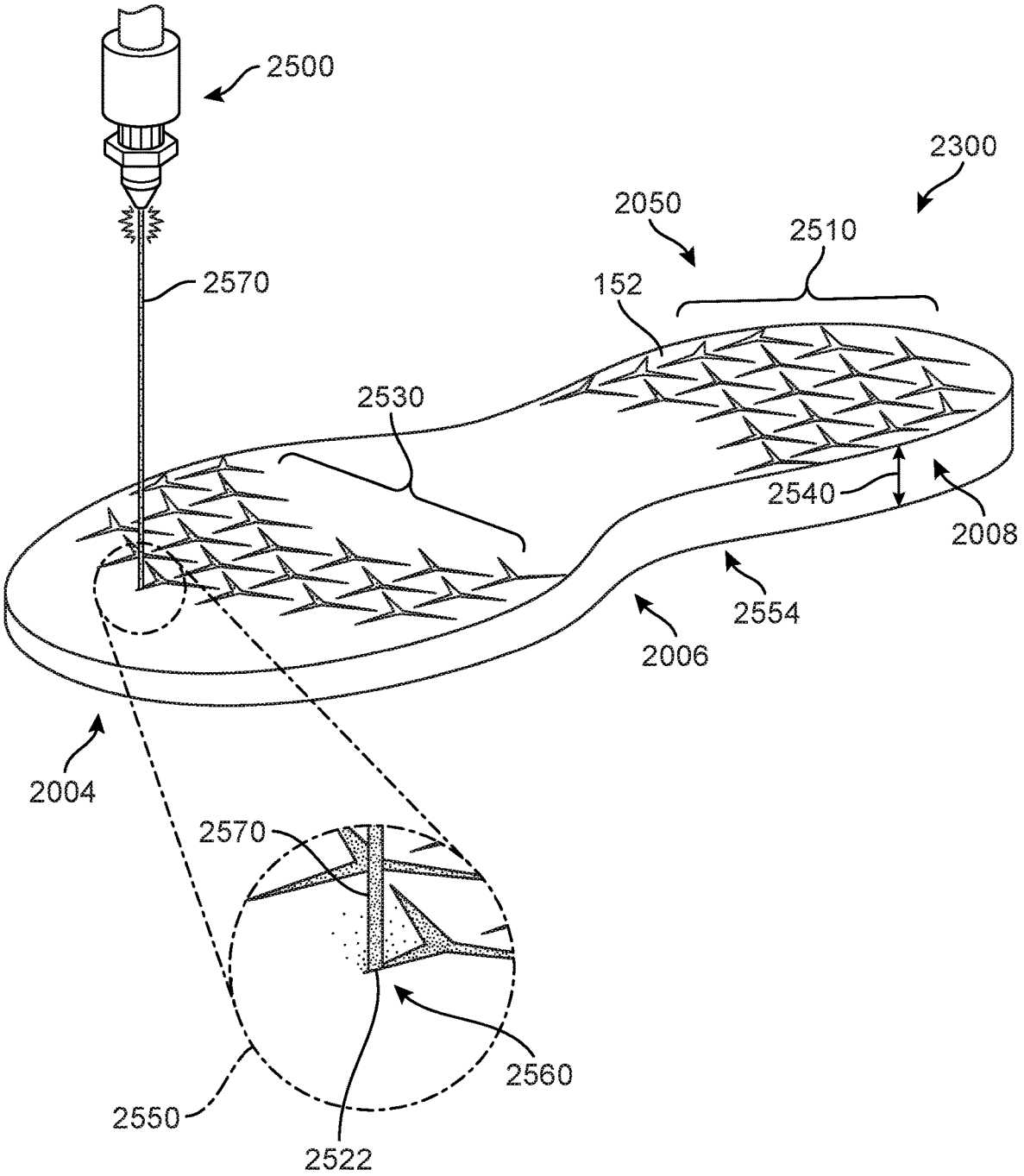
FIG. 20 is an isometric view of an embodiment of a sole member during a process of forming apertures.

In FIG. 20, a figure depicting an embodiment of a method of forming first custom sole 2300, including apertures, is shown. Referring to FIG. 20, apertures 2050 can be applied to or formed in first custom sole 2300 using a laser drill 2500. In one embodiment, laser drill 2500 may be used to cut away or remove material through thickness 2540 of first custom sole 2300. In other cases, there may be a greater number of laser drills used. In FIG. 20, a third group of apertures 2530 along forefoot portion 2004 is being formed along a surface of first custom sole 2300. First group of apertures 2510 in heel portion 2008 and second group of apertures 2520 in midfoot portion 2006 are shown as having been previously formed by laser drill 2500.

Although only apertures in one general portion are shown being drilled in this example, it will be understood that a similar method could be used for creating or forming apertures in any other portion of first custom sole 2300. It should further be understood that laser drill 2500 may include provisions for moving along different directions in order to direct the laser beam to the desired location. Furthermore, the sole member may be disposed such that it may be automatically or manually moved to receive a laser 2570 at the appropriate or desired location, such as along forefoot portion 2004, midfoot portion 2006, and/or heel portion 2008. In addition, while only one laser drill 2500 is shown in use in FIG. 20, in other embodiments, two, three, four, or more laser drills may be engaged with the sole member.

In some embodiments, referring to a magnified area 2550, it can be seen that laser 2570 may contact outer surface 152 of first custom sole 2300. When laser 2570 contacts the material, it may begin to remove material and form a hole 2522. As laser 2570 continues to engage with the material of the sole member, hole 2522 may grow through thickness 2540 and form a first aperture 2560.

It may be recalled that each aperture may be formed such that they differ in one or more respects from one another, or they may be formed in a uniform manner, such that they are substantially similar in size, length, and shape. Furthermore, it should be understood that laser drill 2500 may be oriented at an angle different from that shown in FIG. 20, so that laser drill 2500 can form apertures 2050 oriented in a diagonal or non-parallel manner with respect to vertical axis 170, longitudinal axis 180, and/or lateral axis 190.

While various embodiments of the article of footwear have been described, the description is intended to be exemplary, rather than limiting and it will be apparent to those of ordinary skill in the art that many more embodiments and implementations are possible that are within the scope of the present disclosure. Any element of any embodiment may be used with or substituted for another element in any other embodiment unless specifically restricted. Accordingly, the presently disclosed article of footwear is not to be restricted except in light of the attached claims and their equivalents. Also, various modifications and changes may be made within the scope of the attached claims.

Other systems, methods, features and advantages of the presently disclosed article of footwear will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

What is claimed is:

1. A sole for article of footwear comprising:

a midsole component having an inner surface and an outer surface opposite the inner surface;

wherein the midsole component has a plurality of blind holes each extending from the outer surface toward the inner surface, and the plurality of blind holes is arranged in an auxetic configuration in the outer surface; and wherein the plurality of blind holes includes a first plurality of blind holes in a first region and a second plurality of blind holes in a second region, wherein the first plurality of blind holes has an attribute that is different than a similar attribute of the second plurality of blind holes to provide the first region with a performance characteristic that is different than the second region.

2. The sole of claim 1, wherein the attribute is a depth of the plurality of blind holes.

3. The sole of claim 2, wherein the first plurality of blind holes includes shallow holes in a perimeter of the sole, the second plurality of blind holes includes deep holes disposed between the shallow holes, and the shallow holes are shallower than the deep holes.

4. The sole of claim 3, wherein the plurality of blind holes is disposed in a heel portion of the sole, and the performance characteristic is a heel strike cushioning response.

5. The sole of claim 1, wherein the first plurality of blind holes are disposed in a forefoot portion of the sole, and the second plurality of blind holes are disposed in a heel portion of the sole;

wherein the first plurality of blind holes are arranged in a first pattern, and the second plurality of blind holes are arranged in a second pattern;

wherein the first pattern is different from the second pattern; and wherein the first pattern imparts a first performance characteristic, and the second pattern imparts a second performance characteristic.

6. The sole of claim 5, wherein:

a first forefoot hole of the first plurality of blind holes extends into the midsole component and has a first depth;

a second forefoot hole of the first plurality of blind holes extends into the midsole component and has a second depth, a first heel hole of the second plurality of blind holes extends into the midsole component and has a third depth, and a second heel hole of the second plurality of blind holes extends into the midsole component and has a fourth depth, the first depth is greater than the second depth;

the third depth is greater than the first depth; and the fourth depth is greater than the third depth.

* * * * *